US007157219B2

(12) United States Patent
Simpson et al.

(10) Patent No.: US 7,157,219 B2
(45) Date of Patent: Jan. 2, 2007

(54) PHOTOTHERMOGRAPHIC MATERIALS CONTAINING SILVER HALIDE SENSITIZED WITH COMBINATION OF COMPOUNDS

(75) Inventors: Sharon M. Simpson, Lake Elmo, MN (US); Lilia P. Burleva, Maplewood, MN (US); Kumars Sakizadeh, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 1 day.

(21) Appl. No.: 11/240,560

(22) Filed: Sep. 30, 2005

(65) Prior Publication Data

US 2006/0078833 A1 Apr. 13, 2006

Related U.S. Application Data

(62) Division of application No. 10/731,251, filed on Dec. 9, 2003, now Pat. No. 7,026,105.

(51) Int. Cl.
*G03C 1/08* (2006.01)
*G03C 1/498* (2006.01)

(52) U.S. Cl. ..... 430/611; 430/139; 430/601; 430/600; 430/603; 430/605; 430/619

(58) Field of Classification Search ..... 430/569, 430/567, 619, 605, 600, 603, 611, 620, 601, 430/139
See application file for complete search history.

(56) References Cited

U.S. PATENT DOCUMENTS

| | | | |
|---|---|---|---|
| 3,895,951 | A | 7/1975 | Riester et al. |
| 4,639,414 | A | 1/1987 | Sakaguchi |
| 5,220,030 | A | 6/1993 | Deaton |
| 5,281,515 | A | 1/1994 | Delprato et al. |
| 5,858,637 | A | 1/1999 | Eshelman et al. |
| 5,891,615 | A | 4/1999 | Winslow et al. |
| 6,413,710 | B1 | 7/2002 | Shor et al. |
| 6,423,481 | B1 | 7/2002 | Simpson et al. |
| 6,440,649 | B1 | 8/2002 | Simpson et al. |
| 6,489,091 | B1 | 12/2002 | Takiguchi |
| 6,573,033 | B1 | 6/2003 | Simpson et al. |
| 2005/0123871 | A1 | 6/2005 | Burleva et al. |
| 2005/0123872 | A1 | 6/2005 | Burleva et al. |

FOREIGN PATENT DOCUMENTS

| | | |
|---|---|---|
| EP | 0 713 132 | 12/2000 |
| EP | 1150161 A2 | 10/2001 |
| JP | 2002-23301 | 1/2002 |
| JP | 2002-122958 | 4/2002 |
| JP | 2002-131864 | 5/2002 |

*Primary Examiner*—Thorl Chea
(74) *Attorney, Agent, or Firm*—J. Lanny Tucker; Louis M. Leichter

(57) ABSTRACT

Photothermographic materials are designed with increased photospeed by chemical sensitizing the photosensitive silver halide grains with a combination of compounds. A first chemical sensitizer is a specific gold(III)-containing compound and a second chemical sensitizer is a sulfur-containing compound that is a diphenylphosphine sulfide. The molar ratio of the gold(III)-containing compound to the sulfur-containing compound is at least 1:1.

26 Claims, No Drawings

PHOTOTHERMOGRAPHIC MATERIALS CONTAINING SILVER HALIDE SENSITIZED WITH COMBINATION OF COMPOUNDS

CROSS-REFERENCE TO RELATED APPLICATION

This is a Divisional of application Ser. No. 10/731,251, filed Dec. 9, 2003, now U.S. Pat. No. 7,026,105 now allowed.

FIELD OF THE INVENTION

This invention relates to photothermographic materials containing silver halides that have been chemically sensitized using certain combinations of gold(III)-containing compounds and diphenylphosphine sulfides. It also relates to method of preparing photothermographic emulsions and materials using the combinations of chemical sensitizing compounds, and to methods of imaging the resulting photothermographic materials.

BACKGROUND OF THE INVENTION

Silver-containing photothermographic imaging materials (that is, thermally developable photosensitive imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes,* E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

One of the challenges in the use of photothermographic materials is attaining sufficient photothermographic speed in such materials that are also compatible with conventional imaging sources.

Each of the pure photographic silver halides (silver chloride, silver bromide and silver iodide) and mixed halides (for example silver bromochloroiodide) has its own natural response to radiation, in both wavelength (spectral sensitivity) and efficiency (speed), within the UV, near UV, and blue regions of the electromagnetic spectrum. Thus, silver halide grains, when composed only of silver and halogen atoms, have defined levels of sensitivity depending upon the levels of specific halogens, crystal morphology (shape and structure of the crystals or grains), crystal defects, stresses, dislocations, and dopants, incorporated within or on the crystal lattice of the silver halide.

Chemical sensitization (generally sulfur-sensitization) is a process, during or after silver halide crystal formation, in which sensitization centers [for example, silver sulfide clusters such as $(Ag_2S)_n$ are introduced onto the individual silver halide grains. For example, silver sulfide specks can be introduced by direct reaction of sulfur-contributing compounds with the silver halide during various stages or after completion of silver halide grain growth. These specks usually function as shallow electron traps for the preferential formation of a latent image center. Other chalcogens (Se and Te) can function similarly. The presence of these specks increases the speed or sensitivity of the resulting silver halide grains to radiation. Sulfur-contributing compounds useful for this purpose include thiosulfates (such as sodium thiosulfate) and various thioureas (such as allyl thiourea, thiourea, triethyl thiourea and 1,1'-diphenyl-2-thiourea) as described for example, by Sheppard et al., *J. Franklin Inst.,* 1923, pp. 196, 653, and 673, C. E. K. Mees and T. H. James, *The Theory of the Photographic Process,* 4$^{th}$ Edition, 1977, pp. 152–3, and Tani, T., *Photographic Sensitivity: Theory and Mechanisms,* Oxford University Press, N.Y., 1995, pp. 167–176).

In photothermographic emulsions, the photosensitive silver halide must be in catalytic proximity to (or in reactive association with) the non-photosensitive source of reducible silver ions. Because of the different emulsion making procedures and chemical environments of photothermographic emulsions, the effects achieved by compounds (such as chemical sensitizers) in conventional photographic emulsions are not necessarily possible in photothermographic emulsions.

For example, in photothermographic emulsions, two types of chemical sensitization have been used to increase speed: (a) chemical sensitization of preformed silver halide grains that are then mixed into the solution containing reducible silver ions in some manner, and (b) chemical sensitization of preformed silver halide grains that are already in intimate contact with the reducible silver ions.

In the first approach (a), many of the traditional methods (used for photographic emulsions) can be used, but for the second approach (b), quite specific methods and unique compounds are often needed. Regardless of which approach is used, there is considerable difficulty in attaining additional speed while maintaining low fog (Dmin).

Another method of chemical sensitization is achieved by oxidative decomposition of a sulfur-containing spectral sensitizing dye on or around preformed silver halide grains in a photothermographic emulsion as described in U.S. Pat. No. 5,891,615 (Winslow et al.) by addition of a strong oxidizing agent such as pyridinium hydrobromide perbromide (PHP) to the emulsion. Subsequent to this decomposition, a portion of the non-photosensitive silver salt is converted in-situ to silver halide by addition of an inorganic halide compound.

The use of sodium thiosulfate, triarylphosphine selenide and dibenzoyl ditelluride, or mixtures thereof, as chemical sensitizers for photothermographic materials is also known (see for example, U.S. Pat. No. 4,639,414 of Sakaguchi). The light-sensitive silver halide is said to be chemically sensitized in the presence of a sensitizing dye that is added after the formation of silver halide but before the completion of chemical sensitization.

Various sulfur-containing chemical sensitizers, including various thioureas, are described in U.S. Pat. No. 4,810,626 (Burgmaier et al.), U.S. Pat. No. 4,213,784 (Ikenoue et al.), and U.S. Pat. No. 5,843,632 (Eshelman et al.). Tetrasubstituted thiourea compounds described in U.S. Pat. No. 6,368,779 (Lynch et al.) are shown to provide increased photospeed with minimal loss in Dmin.

Chemical sensitization to increase photospeed has also been achieved by treating the silver halide grains with gold-containing ions such as tetrachloroaurate(III) or dithiocyanatoaurate(I) for example, as described in U.S. Pat. No. 5,220,030 (Deaton) for photographic materials. While gold may be generally added to formulations as gold(III), it is believed that Au(I) is the active species in such uses (see for example, Tani, *Photographic Sensitivity,* Oxford University Press, 1995). U.S. Pat. No. 5,858,637 (Eshelman et al.) also describes various gold(I) compounds that can be used as chemical sensitizers.

More recently, U.S. Pat. No. 6,423,481 (Simpson et al.) describes highly useful gold(III)-containing chemical sensitizing compounds to increase the speed of photothermographic materials while maintaining high Dmax and low Dmin.

Photothermographic materials are constantly being redesigned to meet ever-increasing performance, storage, and manufacturing demands raised by customers, regulators, and manufacturers. One of these demands is increased photospeed without a significant increase in fog (Dmin) or a loss in Dmax. Thus, while the current method of chemical sensitization described in U.S. Pat. No. 5,891,615 (noted above) has provided desired speed for photothermographic emulsions, there is a continued need for an improved method that provides even greater photospeed for such emulsions.

SUMMARY OF THE INVENTION

We have found that the use of a specific combination of gold(III)- and sulfur-containing compounds as chemical sensitizing compounds (chemical sensitizers) provides photothermographic materials with increased photospeed without significant increase in Dmin (fog) or loss in Dmax. In addition, we have found that the present invention provides photothermographic materials with increased shelf-life stability. This combination of chemical sensitizers is particularly useful for preparing X-radiation sensitive photothermographic materials.

This invention provides a photothermographic material comprising a support and having on at least one side thereof, one or more imaging layers comprising a binder and in reactive association:

a. photosensitive silver halide grains, b. a non-photosensitive source of reducible silver ions, and c. a reducing composition for the reducible silver ions, wherein the photosensitive silver halide grains have been chemically sensitized with a combination of chemical sensitizers that consists essentially of:

1) a gold (III)-containing compound that is represented by the following Structure GOLD:

$$Au(III)L'_rY_q \qquad \text{(GOLD)}$$

wherein L' represents the same or different ligands, each ligand comprising at least one heteroatom that is capable of forming a bond with gold, Y is an anion, r is an integer of from 1 to 8, and q is an integer of from 0 to 3, and 2) a sulfur-containing compound that is a diphenylphosphine sulfide that is represented by the following Structure PS:

(PS)

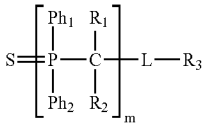

wherein $Ph_1$ and $Ph_2$ are the same or different phenyl groups, $R_1$ and $R_2$ are each independently hydrogen or an alkyl or phenyl group, L is a direct bond or a divalent linking group, m is 1 or 2 and when m is 1, $R_3$ is a monovalent group and when m is 2, $R_3$ is a divalent aliphatic linking group having 1 to 20 carbon, nitrogen, oxygen, or sulfur atoms in the chain, and the molar ratio of the gold (III)-containing compound to the sulfur-containing compound used in the chemical sensitization is at least 1:1.

In preferred embodiments, the present invention provides a X-radiation sensitive photothermographic material comprising a support having on at least one side thereof, a photothermographic imaging layer having a dry coating weight of from about 5 to about 200 g/m$^2$, and a surface protective layer, the imaging layer comprising a hydrophobic binder and in reactive association:

a. a photosensitive silver bromide or silver iodobromide, or both, b. a non-photosensitive source of reducible silver ions that includes silver behenate, c. a reducing composition for the reducible silver ions comprising a hindered phenol or an ascorbic acid, and d. a phosphor that is sensitive to X-radiation and is present in an amount of from about 0.5 to about 20 mole per mole of total silver, the total silver present in the material being at least 0.002 mol/m$^2$, the phosphor being one or more of $YTaO_4$, $YTaO_4$:Nb, $Y(Sr)TaO_4$, and Y(Sr)TaO4:Nb, the silver bromide or silver iodobromide grains having been chemically sensitized with a combination of chemical sensitizers that consists essentially of:

1) one or more of the gold (III)-containing compounds Au-1 to Au-14 that are described below, and 2) one or more of the diphenylphosphine sulfide compounds PS-1 to PS-19 described below, the molar ratio of the gold(III)-containing compound to the diphenylphosphine sulfide compound used in the chemical sensitization is from about 1:1 to about 1:1,000.

This invention also provides a method of preparing a photothermographic emulsion comprising:

(A) providing a dispersion of a preformed photosensitive silver halide grains and a non-photo-sensitive source of reducible silver ions, (B) providing one or more sulfur-containing compounds that is a diphenylphosphine sulfide compound, in association with the preformed silver halide grains and the non-photosensitive source of reducible silver ions, the diphenylphosphine sulfide compound being represented by the Structure PS noted above, (C) chemically sensitizing the preformed silver halide grains by decomposing the diphenylphosphine sulfide compound on or around the silver halide grains in an oxidizing environment to provide sulfur chemically sensitized photosensitive silver halide grains in reactive association with the non-photosensitive source of reducible silver ions, and (D) providing a gold(III)-containing compound in association with the preformed silver halide grains and the non-photosensitive source of reducible silver ions to provide gold(III) chemically sensitized photosensitive silver halide grains in reactive association with the non-photosensitive source of reducible silver ions, the gold(III)-containing compound being represented by the Structure GOLD noted above the molar ratio of the gold(III)-containing compound to the diphenylphosphine sulfide compound used in the chemical sensitization is from about 1:1 to about 1:1,000.

This invention further provides a method of preparing a photothermographic material comprising:

(A) providing a dispersion of preformed photosensitive silver halide grains and a non-photo-sensitive source of reducible silver ions, (B) providing a sulfur-containing compound that is a diphenylphosphine sulfide compound in association with the preformed silver halide grains and the non-photosensitive source of reducible silver ions, the diphenylphosphine sulfide being represented by the Structure PS noted above, (C) chemically sensitizing the preformed silver halide grains by decomposing the diphenylphosphine sulfide compound on or around the silver halide grains in an oxidizing environment to provide sulfur chemically sensitized photosensitive silver halide grains in reactive association with the non-photosensitive source of reducible silver ions, (D) providing a gold(III)-containing compound in association with the preformed silver halide grains and the non-photosensitive source of reducible silver ions to provide gold(III) chemically sensitized photosensitive silver halide grains in reactive association with the non-photosensitive source of reducible silver ions, the gold(III)-containing compound being represented by the Structure GOLD noted above, and (E') simultaneously with any of steps (B) through (D), or subsequently to step (D), adding a binder to form an emulsion formulation, and (F) after step (E'), coating and drying the emulsion formulation on a support to provide a photothermographic imaging material, the molar ratio of the gold(III)-containing compound to the diphenylphosphine sulfide compound used in the chemical sensitization is from about 1:1 to about 1:1,000.

The present invention also provides a method for forming a visible image comprising:

A) imagewise exposing the photothermographic material of the present invention to electromagnetic radiation to form a latent image, and B) simultaneously or sequentially, heating the exposed photothermographic material to develop the latent image into a visible image.

In certain embodiments of this invention, wherein the photothermographic material support is transparent, the method further comprises:

C) positioning the exposed and heat-developed photothermographic material with a visible image therein between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

The specific gold(III)-containing compounds useful in the present invention are defined by the noted Structure "GOLD" noted above and the specific sulfur-containing compounds are diphenylphosphine sulfides defined by Structure "PS" noted above. While the use of each of these types of compounds alone provides some increase in photospeed in photothermographic emulsions, the combination of both types of compounds provides increases in both photospeed and shelf-life stability for the resulting photothermographic materials.

DETAILED DESCRIPTION OF THE INVENTION

The photothermographic materials of this invention can be used in black-and-white or color photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The photothermographic materials of this invention are particularly useful for medical imaging of human or animal subjects in response to visible or X-radiation for use in medical diagnosis. Such applications include, but are not limited to, thoracic imaging, mammography, dental imaging, orthopedic imaging, general medical radiography, therapeutic radiography, veterinary radiography, and auto-radiography. When used with X-radiation, the photothermographic materials of this invention may be used in combination with one or more phosphor intensifying screens, with phosphors incorporated within the photothermographic emulsion, or with a combination thereof. Such materials are particularly useful for dental radiography.

The photothermographic materials of this invention can be made sensitive to radiation of any suitable wavelength. Thus, in some embodiments, the materials are sensitive at ultraviolet, visible, infrared, or near infrared wavelengths, of the electromagnetic spectrum. In these embodiments, the materials are preferably sensitive to radiation greater than 350 nm (such as sensitivity to from about 350 to about 1100 nm). Increased sensitivity to a particular region of the spectrum is imparted through the use of various sensitizing dyes. In some embodiments, the materials are sensitive to X-radiation directly. In preferred embodiments, increased sensitivity to X-radiation is imparted through the use of phosphors.

The photothermographic materials of this invention are also useful for non-medical uses of visible or X-radiation (such as X-ray lithography and industrial radiography). In such imaging applications, it is often desirable that the photothermographic materials be "double-sided."

In the photothermographic materials of this invention, the components needed for imaging can be in one or more photothermographic layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer.

Where the materials contain imaging layers on one side of the support only, various non-imaging layers are usually disposed on the "backside" (non-emulsion or non-imaging side) of the materials, including conductive layers, an antihalation layers, protective layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some applications it may be useful that the photothermographic materials be "double-sided" and have the same or different photothermographic coatings (or imaging layers) on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component (for example, the specific chemical sensitizing compounds).

Heating in a substantially water-free condition as used herein, means heating at a temperature of from about 50° C.

to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process,* Fourth Edition, Eastman Kodak Company, Rochester, N.Y., 1977, p. 374.

"Photothermographic material(s)" means a construction comprising at least one photothermographic emulsion layer or a photothermographic set of emulsion layers, wherein the photosensitive silver halide and the source of reducible silver ions are in one layer and the other essential components or desirable additives are distributed, as desired, in the same layer or in an adjacent coating layer, as well as any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the materials are in the same layer or in adjacent layers so that they readily come into contact with each other during thermal imaging and development.

"Emulsion layer," "imaging layer," or "photothermographic emulsion layer" means a layer of a photothermographic material that contains the photosensitive silver halide (when used) and/or non-photosensitive source of reducible silver ions. It can also mean a layer of the photothermographic material that contains, in addition to the photosensitive silver halide (when used) and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

Many of the materials used herein are provided as a solution. The term "active ingredient" means the amount or the percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed," "speed," or "photographic speed" (also known as sensitivity), absorbance, contrast, Dmin, and Dmax have conventional definitions known in the imaging arts. In photothermographic materials, Dmin is considered herein as image density achieved when the photothermographic material is thermally developed without prior exposure to radiation. It is the average of eight lowest density values on the exposed side of the fiducial mark.

The sensitometric term absorbance is another term for optical density (OD).

Dmax is the maximum density of film in the imaged area.

"SP-2" (Speed-2) is Log 1/E+4 corresponding to the density value of 1.00 above Dmin where E is the exposure in ergs/cm$^2$.

"AC-1" (Average Contrast-1) is the absolute value of the slope of the line joining the density points of 0.60 and 2.00 above $D_{min}$.

"AC-2" (Average Contrast-2) is the absolute value of the slope of the line joining the density points of 1.00 and 2.40 above Dmin.

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided" and "double-faced coating" are used to define photothermographic materials having one or more of the same or different thermally developable emulsion layers disposed on both sides (front and back) of the support. Another term for double-sided is "duplitized."

In the compounds described herein, no particular double bond geometry (for example, cis or trans) is intended by the structures drawn. Similarly, in compounds having alternating single and double bonds and localized charges are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide (and mixtures thereof) are more preferred, with the latter silver halide generally having up to 10 mol % silver iodide.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred, and mixtures of both cubic and tabular grains can be used in the present invention.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetrazaindene (such as 4-hydroxy-6-methyl-1,3,3a,7-tetrazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions.

It is more preferable to form the non-photosensitive source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide—or a halogen-containing compound is added to an organic silver salt to partially convert the silver of the organic silver salt to silver halide. The compound can be one or more inorganic halides (such as zinc bromide, calcium bromide, lithium bromide, or zinc iodide) or an organic halogen-containing compound (such as N-bromosuccinimide or pyridinium hydrobromide perbromide). A portion of the silver halide grains used in the present invention is prepared using an in-situ process. The details of such in-situ generation of silver halide are well known and described for example in U.S. Pat. No. 3,457,075 (Morgan et al.). Further details of this procedure are provided below. Zinc bromide is preferably added in the practice of this invention.

It is particularly effective to use a mixture of both preformed and in-situ generated silver halide.

Additional methods of preparing these silver halide and organic silver salts and manners of blending them are described in *Research Disclosure,* June 1978, item 17029, U.S. Pat. No. 3,700,458 (Lindholm), U.S. Pat. No. 4,076,539 (Ikenoue et al.), JP Kokai 49-013224, (Fuji), JP Kokai 50-017216 (Fuji), and JP Kokai 51-042529 (Fuji).

The silver halide grains used in the imaging formulations can vary in average diameter of up to several micrometers (μm) depending on the desired use. Preferred silver halide grains are those having an average particle size of from about 0.01 to about 1.5 μm, more preferred are those having an average particle size of from about 0.03 to about 1.0 μm, and most preferred are those having an average particle size of from about 0.05 to about 0.8 μm. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 μm.

The average size of the doped photosensitive silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process,* Third Edition, Macmillan, N.Y., 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

A combination of compounds for chemical sensitization is used in the present invention to increase the photospeed of the photosensitive silver halides used in the photothermographic materials of the invention.

At least one of the chemical sensitizing compounds is a gold(III)-containing compound represented by the following Structure GOLD:

$$Au(III)L'_rY_q \qquad \text{GOLD}$$

wherein L' represents the same or different ligands, each ligand comprising at least one heteroatom that is capable of forming a bond with gold, Y is an anion, r is an integer of from 1 to 8, and q is an integer of from 0 to 3. Mixtures of these compounds can be used if desired.

More particularly, L' represents the same or different ligands that comprise at least one oxygen, nitrogen, sulfur, or phosphorous atom. Examples of such ligands include but are not limited to, pyridine, bipyridine, terpyridine, P(phenyl)$_3$, carboxylate, imine, phenol, mercaptophenol, imidazole, triazole, and dithiooxamide The preferred L' ligands are derived from terpyridine, P(phenyl)$_3$, and salicylimine compounds.

Also in the noted GOLD Structure, Y represents an appropriate counter anion having the appropriate charge. Useful anions include but are not limited to, halides (such as chloride and bromide), perchlorate, tetrafluoroborate, sulfate, sulfonate, methylsulfonate, p-toluenesulfonate, tetrafluoroantimonate, and nitrate. Halides are preferred.

The GOLD Structure also comprises r that is an integer from 1 to 8 (preferably from 1 to 3), and q is 0 or an integer from 1 to 3 (preferably, 3).

Useful gold(III)-containing chemical sensitizers can be prepared using known methods. Representative synthetic methods are described in the literature citations provided in below. In addition, some gold(III)-containing compounds can be obtained from various commercial sources including Alfa Aesar (Ward Hill, Mass.).

Particularly useful gold(III)-containing chemical sensitizers are the following Compounds Au-1 to Au-14 shown below.

| Compound | Au(III) Complex | Ligand-H (L'-H) | Method of Preparation |
|---|---|---|---|
| (Au-1) | $AuL'ClBr_2$ | P(phenyl)$_3$ | F. Mann et al., J. Chem. Soc., 1940, 1235, |
| (Au-2) | $AuL'Cl_3$ | 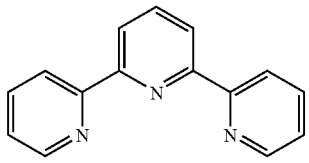 Terpyridine | L. Hollis et al., J. Am. Chem. Soc., 1983, 105, 4293 |
| (Au-3) | $AuL'Br_2$ | 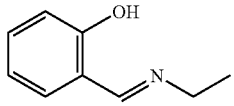 | A. Dar et al., J. Chem. Soc., Dalton Trans., 1992, 1907 |
| (Au-4) | $AuL'Cl_3$ | 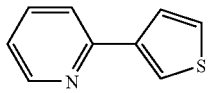 | Y. Fuchita et al., J. Chem. Soc., Dalton Trans. 1999, 4431 |
| (Au-5) | $L'[AuP(phenyl)_3]_3$ | 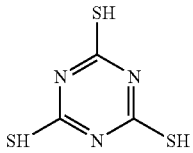 | W. Hunks et al, Inorg. Chem., 1999, 38, 5930 |

-continued

| Compound | Au(III) Complex | Ligand-H (L'-H) | Method of Preparation |
|---|---|---|---|
| (Au-6) | $AuL'Cl_3$ | 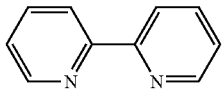 | M. Cinellu et al., J. Chem. Soc., Dalton Trans., 1998, 1735 |
| (Au-7) | $AuH(L')_2Cl_2$ | 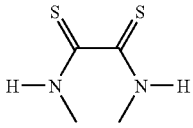 | B. Slootmaekers et al., Spectrochim. Acta, 1996, 52A, 1255 |
| (Au-8) | $AuL'Cl_2$ | 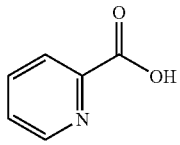 | A. Dar et al. J. Chem. Soc., Dalton Trans., 1992, 1907 |
| (Au-9) | $Au_2Zn(L')_8$ | 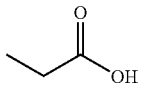 | P. G. Jones et al., Acta Cryst., 1988, C44 1196. |
| (Au-10) | $AuPF_6(L')_2$ | 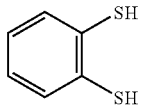 and 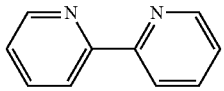 | M. A. Mansour, R. J. Lachicotte, H. J. Gysling, R. Eisenberg, Inorg. Chem., 37 (1998) 4625. |
| (Au-11) | $Au(L')_2Br$ | 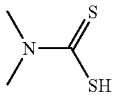 | D. J. Radanovic et al., Trans. Met. Chem., 1996, 21, 169 |
| (Au-12) | $AuL'Cl_3$ | 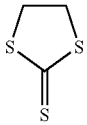 | H. G. Raubenheimer et al., Polyhedron, 1992, 11, 893. |
| (Au-13) | $Au(L')_2(ClO_4)_3$ | Diferrocenylphenyl-phosphine | C. M. Gimeno, et al. J. Organomet. Chem., 1999, 579, 206. |
| (Au-14) | AuL'Cl | Glycylglycyl-L-histidine | S. L. Sabine et al., J. Chem. Soc., Dalton Trans., 1997, 2587 |

Other gold-containing chemical sensitizing compounds [both gold(I) and gold(III) compounds] can also be used in the practice of this invention as long as at least 50 mol % of the gold-containing compounds used in the invention are those represented by Structure GOLD noted above.

Another chemical sensitizing compound used in the present invention is a diphenylphosphine sulfide that can be defined using the following general Structure (PS):

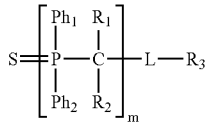

(PS)

wherein $Ph_1$ and $Ph_2$ are the same or different substituted or unsubstituted phenyl groups. Substituents on the phenyl groups can include but are not limited to, halogen, alkyl, alkoxy, cyano, and nitro.

Also in Structure (PS), $R_1$ and $R_2$ are each independently hydrogen, a substituted or unsubstituted alkyl group having 1 to 10 carbon atoms (such as methyl, ethyl, iso-propyl, or cyclohexyl), or a substituted or unsubstituted phenyl group (such as phenyl, 4-methylphenyl, and 3-chlorophenyl). Preferably, $R_1$ and $R_2$ are both hydrogen or at least one of $R_1$ and $R_2$ is hydrogen. More preferably, $R_1$ and $R_2$ are both hydrogen.

Further, m is 1 or 2 and preferably m is 1.

L represents a direct bond, or an organic linking group having 1 to 3 atoms in the chain. Preferred linking groups are sulfonyl [—$SO_2$—], carbonyl [—(C═O)—], and sulfoxide [—SO—]. Most preferably the linking group is carbonyl [—(C═O)—].

When m is 1, $R_3$ is a monovalent group such as a substituted or unsubstituted alkyl group having 1 to 16 carbon atoms, preferably 1 to 7 carbon atoms (such as methyl, benzyl, and methylcarbophenyl, groups), a substituted or unsubstituted aryl group (such as phenyl, naphthyl, fruanyl group), a disubstituted amino group (such as methylamino, dimethylamino, diethylamino, morpholino, or piperdino groups). When m is 2, $R_3$ is a substituted or unsubstituted divalent aliphatic linking group having 1 to 20 carbon, nitrogen, oxygen, or sulfur atoms in the chain (such as methylene, ethylene, propylene, polyether, or polythioether groups). Preferably, m is 1 and $R_3$ is a diethylamino or a phenylgroup.

Representative compounds of Structure (PS) include the following PS-1 to PS-19 compounds:

(PS-1)

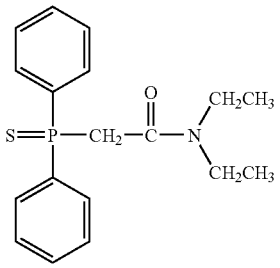

(PS-2)

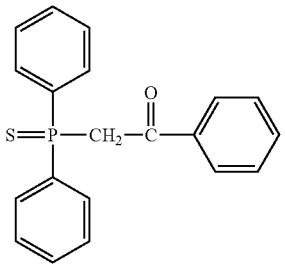

-continued (PS-3)

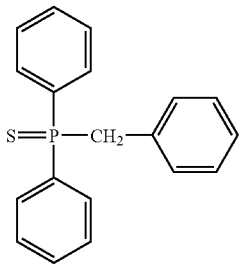

(PS-4)

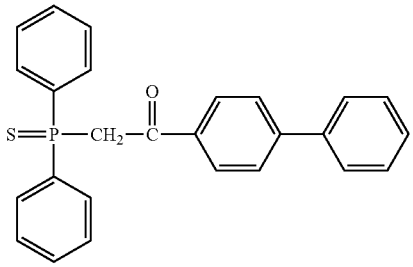

(PS-5)

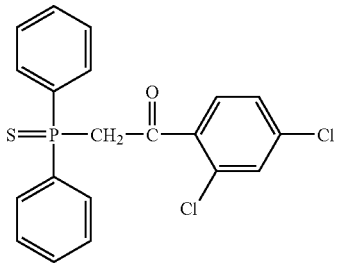

(PS-6)

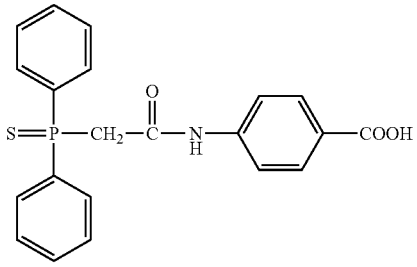

(PS-7)

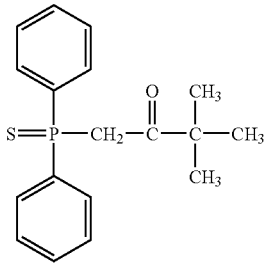

(PS-8)

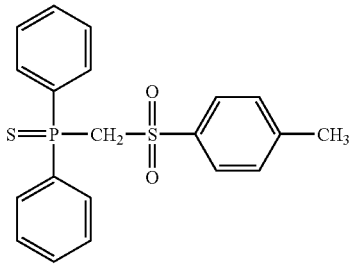

-continued
(PS-9)
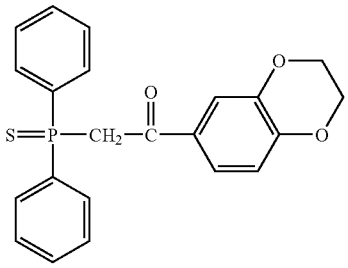
(PS-10)
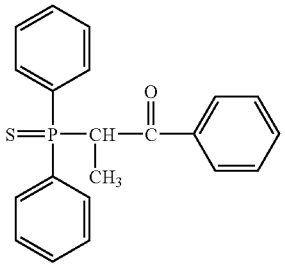
(PS-11)
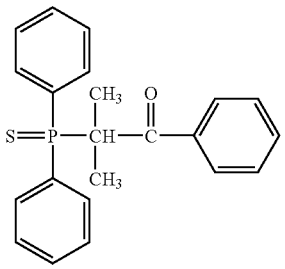
(PS-12)
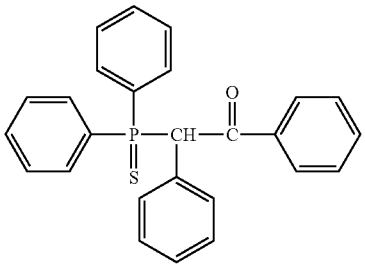
(PS-13)
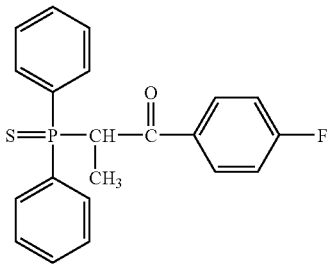
-continued
(PS-14)
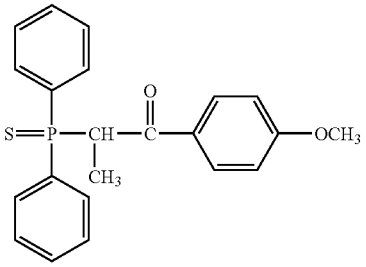
(PS-15)
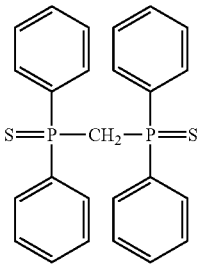
(PS-16)
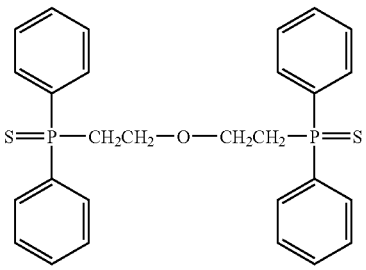
(PS-17)
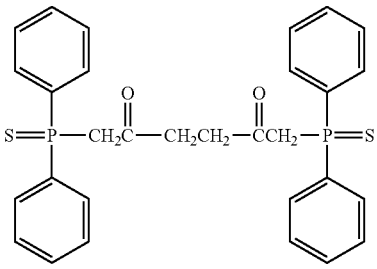
(PS-18)
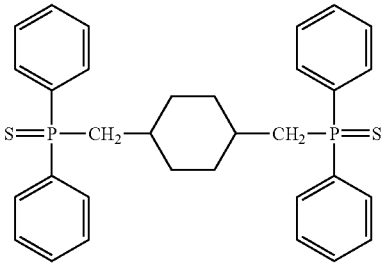

-continued (PS-19)

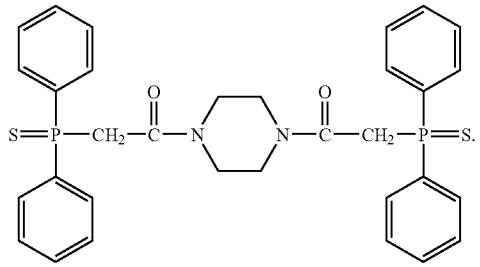

Mixtures of such sulfur-containing compounds can be used if desired. Compounds PS-1 and PS-2 are most preferred.

The diphenylphosphine sulfides useful in the practice of this invention can be prepared generally by alkylation of diphenylphosphine sulfide in methylene chloride at a temperature of from about 0° C. to about room temperature for from about 30 minutes to about 24 hours in the presence of powdered potassium hydroxide. A representative synthetic method is provided below prior to the Examples.

The following SCHEME I depicts the preparation of the diphenylphosphine sulfide compounds of this invention were L is a carbonyl group.

SCHEME I

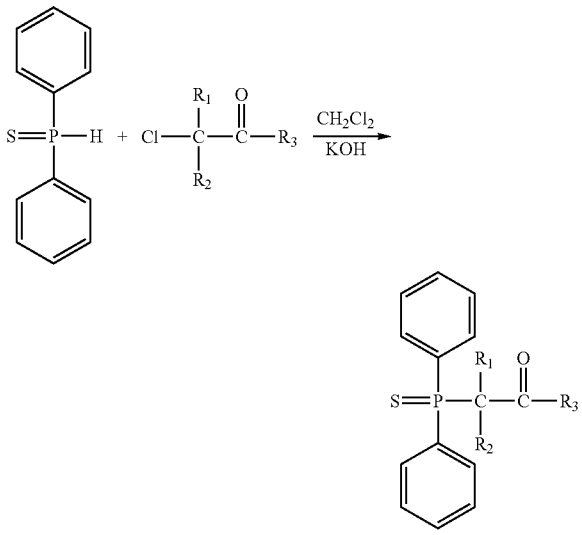

The gold(III)-containing compounds described herein are incorporated into the silver halide grains by addition of a solution of the gold(III) compound during the preparation of the photothermographic emulsion. As noted below, the point of addition of the gold(III) compound appears not to be critical.

Thus the photothermographic emulsions useful in the present invention can be prepared generally by:

(A) providing a dispersion of a preformed photosensitive silver halide grains and a non-photo-sensitive source of reducible silver ions, (B) providing one or more diphenylphosphine sulfide compounds as described herein, in association with the preformed silver halide grains and the non-photosensitive source of reducible silver ions, (C) chemically sensitizing the preformed silver halide grains by decomposing the diphenylphosphine sulfide compound on or around the silver halide grains in an oxidizing environment to provide sulfur chemically sensitized photosensitive silver halide grains in reactive association with the non-photosensitive source of reducible silver ions, and (D) providing one or more gold(III)-containing compounds as described herein in association with the preformed silver halide grains and the non-photosensitive source of reducible silver ions to provide gold(III) chemically sensitized photosensitive silver halide grains in reactive association with the non-photosensitive source of reducible silver ions.

An optional additional step for this method comprises:

(E) converting some of the reducible silver ions in the non-photosensitive source of reducible silver ions to photosensitive silver halide.

The order of the steps used in preparing the final photothermographic emulsion is not critical so long as step (A) occurs first and step (C) occurs at some point after steps (A) and (B). In preferred embodiments, steps (A) through (D), and optionally step (E), are carried out in the designated order.

However, in other embodiments, the arrangement of steps can be any of the following schemes [including optional step (E)] to provide useful photothermographic emulsions:

Step (A), step (B), step (C), step (E), and step (D).
Step (A), step (B), step (D), step (E), and step (C).
Step (A), step (B), step (D), step (C), and step (E).
Step (A), step (B), step (E), step (C), and step (D).
Step (A), step (B), step (E), step (D), and step (C).
Step (A), step (D), step (B), step (C), and step (E).
Step (A), step (D), step (B), step (E), and step (C).
Step (A), step (D), step (B), step (E), and step (C).
Step (A), step (E), step (D), step (B), and step (C).
Step (A), step (E), step (B), step (D), and step (C).
Step (A), step (E), step (B), step (C), and step (D).

In other embodiments, step (B) and step (D) can be carried out simultaneously, step (D) and step (E) can be carried out simultaneously, step (B) and step (E) can be carried out simultaneously, and step (B), step (D), and step (E) can be carried out simultaneously, all before step (C).

While step (E) is optional, it is used in preferred embodiments of the present invention. It is particularly preferred in preparing photothermographic materials having a sensitivity to wavelengths greater than 600 nm In step (B), one or more organic sulfur-containing compounds are added and suitably mixed with the photothermographic dispersion. We believe that in this step, the organic sulfur-containing compound becomes located on or around the surface of the silver halide grains.

Step (C) comprises decomposing the sulfur-containing diphenylphosphine sulfide compound(s) on or around the photosensitive silver halide grains in an oxidizing environment. Such decomposition is generally carried out using one or more oxidizing agents, and preferably a "strong" oxidizing agent, that is capable of forming species on the grains that act as the chemical sensitizer at a temperature from about 10° C. up to about 30° C. for up to 60 minutes. Preferably, the reaction is carried out from ambient temperature (generally about 20° C.) up to about 30° C.

While not intending to be limited to any theory or mechanism, Applicants believe that upon addition to the photothermographic dispersion, the diphenylphosphine sulfide(s) described herein becomes located on or around the surface of the silver halide grains. Oxidative decomposition of these compounds provides a residue or reaction product that reacts with silver halide grains to provide chemical sensitization sites on the grains. These sites can be in the form of silver or silver sulfide specks. For example, when the preferred oxidizing agents (for example, PHP described below) are used, they may react with the diphenylphosphine sulfide compounds associated with the silver halide grain surfaces to produce or form one or more compounds (such as HSBr) that will in turn directly react with the silver halide grain surfaces to form an ordered distribution of chemically sensitized sites.

The efficiency of the decomposition is influenced by the function and efficiency of the oxidizing agent(s), the particular sulfur-containing compound that is decomposed, the length of decomposition time, and the decomposition temperature More reactive oxidizing agents can be used at lower temperature and/or shorter times, and the converse is true for less reactive oxidizing agents.

Decomposition can be carried out in a single reaction or is stages where the reaction is interrupted or completed before addition of the same or different oxidizing agent. Thus, in some embodiments, a single oxidizing agent can be provided in a "portioned" addition where the total amount is divided into portions and added in stages.

Preferred oxidizing agents include hydrobromic acid salts of N-heterocyclic ring compounds (such as hydrobromic acid salts of heterocyclic compounds) that are further associated with a pair of bromine atoms. These compounds are also known as quaternary nitrogen-containing 5-, 6-, or 7-membered monocyclic or polycyclic rings that are associated with hydrobromic acid perbromide. Examples of such compounds are described as antifoggants in U.S. Pat. No. 5,028,523 (Skoug) that is incorporated herein by reference, and include compounds with substituted or unsubstituted pyridine, pyrrolidone, pyrrolidinone, pyrrolidine, phthalazinone, and phthalazine rings. The compounds with a pyridine ring are more preferred and a particularly useful oxidizing agent is pyridinium hydrobromide perbromide (PHP).

In a preferred embodiment, PHP is used as the oxidizing agent at a temperature of from about 20° C. to about 30° C. for up to 60 minutes.

Following the decomposition step, the photothermographic emulsion can be further modified by the addition of conventional additional chemical sensitizers that do not require oxidization, binders, toners, antifoggants, spectral sensitizing dyes, matting agents, phosphors, and other addenda commonly included within such emulsions. Further details of these compounds are provided below as well as in considerable published literature. Reducing agents (described below) can also be added at one or more times during the preparation of the photothermographic emulsion.

In step (E), a portion of the reducible silver ions in the non-photosensitive source of reducible silver ions is converted to photosensitive silver halide by an in-situ process in which a halide-containing compound is added to an organic silver salt. Such compounds can be inorganic halides (such as zinc bromide, calcium bromide, lithium bromide, or zinc iodide or mixtures thereof) or organic halogen-containing compounds (such as N-bromosuccinimide or pyridinium hydrobromide perbromide). The conversion of the reducible silver ions in step (E) can be carried out by one addition of one the noted halide-containing compounds or by multiple additions thereof at various times in the preparation of the photothermographic emulsion formulation. For example, a portion of the halide-containing compound can be added before the diphenylphosphine sulfide compound and a second portion can be added after the addition of the diphenylphosphine sulfide compound. Different halide-containing compounds can be used in these steps if desired. For example, a bromide salt can be added with an iodide salt, and then a bromide salt can be added alone. If mixtures of halides are added, they are added in a proportion to provide desired halide composition in the resulting silver halide grains. Zinc bromide is preferably added in the practice of this invention.

It is particularly effective to use a mixture of both preformed and in-situ generated silver halide.

The halogen-containing compound(s) is added in an amount sufficient to convert from about 0.1 to about 10 mol % of the reducible silver ions to photosensitive silver halide. Preferably from about 0.5 to about 5 mol % of the reducible silver ions are converted to photosensitive silver halide. More preferably from about 1 to about 3 mol % of the reducible silver ions are converted. The halogen-containing compound(s) is added in an amount of from about $10^{-4}$ to about $10^{-1}$ mole halogen atom per mole of non-photosensitive source of reducible silver ions. Generally, conversion of the reducible silver ions occurs within 30 minutes at an appropriate temperature.

The chemical sensitizers described herein can be present in one or more imaging layer(s) disposed on the front- or back-side (or both sides) of the photothermographic material. Preferably, they are used on all photosensitive silver halide grains within the material.

It would be readily determinable by routine experimentation as to the optimum time for adding particular chemical sensitizers to achieve the maximum speed enhancement in the photothermographic emulsion.

The photothermographic materials of the present invention contain silver halide grains that have been chemically sensitized with the gold(III)-containing compound(s) in an amount of from about $10^{-8}$ to about $10^{-2}$ mole per mole of total silver and with the noted diphenylphosphine sulfide(s) in an amount of from about $10^{-6}$ to about $10^{-1}$ mole per mole of total silver. Preferably, the photothermographic materials of the present invention contain silver halide grains that have been chemically sensitized with the gold(III)-containing compound(s) in an amount of from about $10^{-6}$ to about $10^{-5}$ mole per mole of total silver and the noted diphenylphosphine sulfide(s) in an amount of from about $10^{-4}$ to about $10^{-3}$ mole per mole of total silver.

In addition, the molar ratio of the gold(III)-containing compound used as a chemical sensitizer to the diphenylphosphine sulfide used as chemical sensitizer is at least 1:1 and preferably from about 1:10 to about 1:5,000, and preferably from about 1:1 to about 1:1,000.

Besides the gold(III) and diphenylphosphine sulfide chemical sensitizing compounds described above, one or more "additional" chemical sensitizers may be used, if desired, to further increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process,* Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727

(Deaton), U.S. Pat. No. 5,912,111 (Lok et al.), U.S. Pat. No. 5,759,761 (Lushington et al.), and EP 0 915 371A1 (Lok et al.).

In addition, mercaptotetrazoles and tetraazindenes as described in U.S. Pat. No. 5,691,127 (Daubendiek et al.), incorporated herein by reference, can be used as suitable addenda for tabular silver halide grains.

Examples of additional sulfur sensitizers include compounds such as thiosulfates, thioureas, thiazoles, rhodanines, thiosulfates, and thioureas. In one embodiment, additional chemical sensitization is achieved by oxidative decomposition of a sulfur-containing spectral sensitizing dye in the presence of a photothermographic emulsion as described in U.S. Pat. No. 5,891,615 (Winslow et al.), incorporated herein by reference.

In another embodiment, certain substituted and unsubstituted thiourea compounds can be used as additional chemical sensitizers, such as tetra-substituted thioureas described in U.S. Pat. No. 6,368,779 (Lynch et al.), that is incorporated herein by reference.

Still other additional chemical sensitizers include certain tellurium-containing compounds that are described in U.S. Published Application 2002-0164549 (Lynch et al.), and certain selenium-containing compounds that are described in U.S. Pat. No. 6,620,577 (Lynch et al.), that are both incorporated herein by reference.

The additional chemical sensitizers described above can be used in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 μM. The upper limit can vary depending upon the compound(s) used, the level of silver halide and the average grain size, and would be readily determinable by one of ordinary skill in the art.

Spectral Sensitizers

The photosensitive silver halides used in the photothermographic features of the invention may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes, merocyanine dyes and complex merocyanine dyes are particularly useful. Spectral sensitizing dyes are chosen for optimum photosensitivity, stability, and ease of synthesis. They may be added at any stage in chemical finishing of the photothermographic emulsion. Spectral sensitization is generally carried out by adding one or more spectral sensitizing dyes to the photothermographic emulsion after chemical sensitization is achieved. For example, spectral sensitizers can be added after step (C) noted above for the methods of making the photothermographic emulsions and materials. Such spectral sensitizers can provide spectral sensitization in the range of from about 350 to about 1100 nm.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP Kokai 2000-063690 (Tanaka et al.), JP Kokai 2000-112054 (Fukusaka et al.), JP Kokai 2000-273329 (Tanaka et al.), JP Kokai 2001-005145 (Arai), JP Kokai 2001-064527 (Oshiyama et al.), and JP Kokai 2001-154305 (Kita et al.), can be used in the practice of the invention. All of the publications noted above are incorporated herein by reference. A summary of generally useful spectral sensitizing dyes is contained in *Research Disclosure,* December 1989, item 308119, Section IV. Additional classes of dyes useful for spectral sensitization, including sensitization at other wavelengths are described in *Research Disclosure,* 1994, item 36544, section V.

Teachings relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat. Such dyes are described in U.S. Pat. No. 4,524,128 (Edwards et al.), JP Kokai 2001-109101 (Adachi), JP Kokai 2001-154305 (Kita et al.), and JP Kokai 2001-183770 (Hanyu et al.).

Spectral sensitizing dyes may be used singly or in combination. The dyes are selected for the purpose of adjusting the wavelength distribution of the spectral sensitivity, and for the purpose of supersensitization. When using a combination of dyes having a supersensitizing effect, it is possible to attain much higher sensitivity than the sum of sensitivities that can be achieved by using each dye alone. It is also possible to attain such supersensitizing action by the use of a dye having no spectral sensitizing action by itself, or a compound that does not substantially absorb visible light. Diaminostilbene compounds are often used as supersensitizers.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the photothermographic materials of this invention can be any metal-organic compound that contains reducible silver (1+) ions. Such compounds are generally silver salts of silver coordinating ligands. Preferably, it is an organic silver salt that is comparatively stable to light and forms a silver image when heated to 50° C. or higher in the presence of an exposed photocatalyst (such as silver halide, when used in a photothermographic material) and a reducing composition.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver carboxylates.

Representative silver salts of aromatic carboxylic acid and other carboxylic acid group-containing compounds include, but are not limited to, silver benzoate, silver substituted-benzoates (such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Silver salts of sulfonates are also useful in the practice of this invention. Such materials are described for example in U.S. Pat. No. 4,504,575 (Lee). Silver salts of sulfosuccinates are also useful as described for example in EP 0 227 141A1 (Leenders et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)].

Examples of other useful silver salts of mercapto or thione substituted compounds that do not contain a heterocyclic nucleus include but are not limited to, a silver salt of thioglycolic acids such as a silver salt of an S-alkyl-thioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a silver salt of a compound containing an imino group is preferred, especially in aqueous-based imaging formulations. Preferred examples of these compounds include, but are not limited to, silver salts of benzotriazole and substituted derivatives thereof (for example, silver methyl-benzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of benzotriazole is preferred in aqueous-based photothermographic formulations.

Moreover, silver salts of acetylenes can also be used as described, for example in U.S. Pat. No. 4,761,361 (Ozaki et al.) and U.S. Pat. No. 4,775,613 (Hirai et al.).

Organic silver salts that are particularly useful in organic solvent-based photothermographic materials include silver carboxylates (both aliphatic and aromatic carboxylates), silver triazolates, silver sulfonates, silver sulfo-succinates, and silver acetylides. Silver salts of long-chain aliphatic carboxylic acids containing 15 to 28, carbon atoms (and including silver behenate) are particularly preferred.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercially available fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure,* April 1983, item 22812, *Research Disclosure,* October 1983, item 23419, U.S. Pat. No. 3,985,565 (Gabrielsen et al.) and the references cited above.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Another useful source of non-photosensitive reducible silver ions in the practice of this invention are the silver dimer compounds that comprise two different silver salts as described in U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, Whitcomb, Howlader, and Leichter) that is incorporated herein by reference.

As one skilled in the art would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the photothermographic materials is generally at least 0.002 mol/m$^2$ and preferably from about 0.01 to about 0.05 mol/m$^2$.

Reducing Agents

The reducing agent (or reducing agent composition comprising two or more components) for the source of reducible silver ions can be any material, preferably an organic material, that can reduce silver (1+) ion to metallic silver.

Conventional photographic developers can be used as reducing agents, including aromatic di- and tri-hydroxy compounds (such as hydroquinones, gallatic acid and gallic acid derivatives, catechols, and pyrogallols), aminophenols (for example, N-methylaminophenol), p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxy-tetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When a silver benzotriazole silver source is used, ascorbic acid reducing agents are preferred. An "ascorbic acid" reducing agent (also referred to as a developer or developing agent) means ascorbic acid, complexes, and derivatives thereof. Ascorbic acid developing agents are described in a considerable number of publications in photographic processes, including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure,* item 37152, March 1995. D-, L-, or D,L-ascorbic acid (and alkali metal salts thereof) or isoascorbic acid (or alkali metal salts thereof) are preferred. Mixtures of these developing agents can be used if desired.

When a silver carboxylate silver source is used in a photothermographic material, hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below. Hindered phenol reducing agents are preferred (alone or in combination with one or more high-contrast co-developing agents and co-developer contrast enhancing agents).

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxy-biphenyls), bis(hydroxynaphthyl)methanes, bis(hydroxyphenyl) methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetra-methylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX® WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethyiphenol) (LOWINTOX® 221 B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

Mixtures of hindered phenol reducing agents can be used if desired.

Still another useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetra-hydroxy-1,1'-spiro-bis-indane (called indane I) and 3,3,3',3'-tetramethyl-4,6,7,4',6',7'-hexahydroxy-1,1'-spiro-bis-indane (called indane II).

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

More specific alternative reducing agents that have been disclosed in dry silver systems including amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxyethyl)-propionyl-β-phenyl hydrazide in combination with ascorbic acid], a combination of polyhydroxy-benzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example, phenothiazine and 2,6-dichloro-4-benzenesulfonamidophenol), α-cyanophenyl-acetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis (2-hydroxy-1-naphthyl)-methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfon-amidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), and 3-pyrazolidones.

Useful co-developer reducing agents can also be used as described for example, in U.S. Pat. No. 6,387,605 (Lynch et al.), that is incorporated herein by reference. Examples of these compounds include, but are not limited to, 2,5-dioxocyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

Aromatic di- and tri-hydroxy reducing agents can also be used in combination with hindered phenol reducing agents either together or in or in combination with one or more high-contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxy-phenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzylidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbance are provided in U.S. Pat. No. 5,491,059 (noted above, Col. 14).

The total amount of one or more dye-forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, Dmin, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228B1 (Philip Jr. et al.). These compounds are useful as addenda when added to the emulsion along with the sensitizing dye (where they are especially beneficial with red and infrared sensitive films), and especially when used in organic [for example, poly(vinyl butyral)] or aqueous latex binders.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of this invention can be further protected against the production of fog and can be stabilized against loss of sensitivity during storage. While not necessary for the practice of the invention, it may be advantageous to add mercury (2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat.

No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example, in EP 0 600 586A1 (Philip, Jr. et al.), and tribromomethylketones as described, for example, in EP 0 600 587A1 (Oliff et al.).

Preferably, the photothermographic materials of the present invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a $—SO_2C(X')_3$ group wherein X' represents the same or different halogen atoms.

Advantageously, the photothermographic materials of this invention also include one or more thermal solvents (or melt formers). Representative examples of such compounds include, but are not limited to, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, dimethylurea, D-sorbitol, and benzene-sulfonamide. Combinations of these compounds can also be used including a combination of succinimide and dimethylurea. Known thermal solvents are disclosed, for example, in U.S. Pat. No. 3,438,776 (Yudelson), U.S. Pat. No. 5,250,386 (Aono et al.), U.S. Pat. No. 5.368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials according to the invention to provide improved and more effective image development. A base-release agent or base precursor as employed herein is intended to include compounds which upon heating in the photothermographic material provide a more effective reaction between the described photosensitive silver halide, and the image-forming combination comprising a silver salt and the silver halide developing agent. Representative base-release agents or base precursors include guanidinium compounds, such as guanidinium trichloroacetate, and other compounds that are known to release a base but do not adversely affect photographic silver halide materials, such as phenylsulfonyl acetates. Further details are provided in U.S. Pat. No. 4,123,274 (Knight et al.).

A range of concentration of the base-release agent or base precursor is useful in the described photothermographic materials. The optimum concentration of base-release agent or base precursor will depend upon such factors as the desired image, particular components in the photothermographic material, and processing conditions.

The use of "toners" or derivatives thereof that improve the image are highly desirable components of the photothermographic materials. Toners are compounds that when added to the photothermographic imaging layer(s) shift the color of the developed silver image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer(s) or in an adjacent layer.

Compounds useful as toners are described for example in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Phthalazine and phthalazine derivatives [such as those described in U.S. Pat. No. 6,146,822 (Asanuma et al.), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and U.S. Pat. Nos. 6,713,240 and 6,841,343 (Lynch et al.), all of which are incorporated herein by reference.

Also useful are the phthalazine compounds described in commonly assigned U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt(3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof, phthalazinone and phthalazinone derivatives, or metal salts or these derivatives [such as 4-(1-naphthyl)-phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones and naphthoxazine diones (such as 1,3-benzoxazine-2,4-dione, 8-methyl-1,3-benzoxazine-2,4-dione, 3,4-dihydro-2,4-dioxo-1,3,2H-benzoxazine, 3,4-dihydro-2,4-dioxo-1,3,7-ethylcarbonatobenzoxazine, and 6-nitro-1,3-benzoxazine-2,4-dione) as described in U.S. Pat. No. 5,817,598 (Defieuw et al.), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

The photothermographic materials of this invention can also include one or more image stabilizing compounds that are usually incorporated in a "backside" layer. Such compounds can include, but are not limited to, phthalazinone and its derivatives, pyridazine and its derivatives, benzoxazine and benzoxazine derivatives, benzothiazine dione and its derivatives, and quinazoline dione and its derivatives, particularly as described in commonly assigned U.S. Pat. No. 6,599,685 (Kong). Other useful backside image stabilizers include, but are not limited to, anthracene compounds, coumarin compounds, benzophenone compounds, benzotriazole compounds, naphthalic acid imide compounds, pyrazoline compounds, or compounds described for example, in U.S. Pat. No. 6,465,162 (Kong et al.) and GB 1,565,043 (Fuji Photo). All of these patents and patent applications are incorporated herein by reference.

Phosphors

In some embodiments, it is also effective to incorporate X-radiation-sensitive phosphors in the chemically sensitized photothermographic emulsions and materials described herein. Organic solvent-based emulsions and materials are described in U.S. Pat. No. 6,440,649 (Simpson et al.) and aqueous-based emulsions and materials are described in U.S. Pat. No. 6,573,033 (Simpson et al.), both of which are incorporated herein by reference.

Any conventional or useful phosphor can be used, singly or in mixtures, in the practice of this invention. More specific details of useful phosphors are provided as follows.

Phosphors are materials that emit infrared, visible, or ultraviolet radiation upon excitation. An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants "activate" the phosphor and cause it to emit infrared, visible, or ultraviolet radiation. For example, in $Gd_2O_2S$:Tb, the Tb atoms (the dopant/activator) give rise to the optical emission of the phosphor.

Some phosphors, such as BaFBr, are known as storage phosphors. In these materials, the dopants are involved in the storage as well as the emission of radiation. When storage phosphors are incorporated within the photothermographic materials, the initial exposure to X-radiation is "stored" within the phosphor particles. When the material is then later exposed a second time to stimulating electromagnetic radiation (usually to visible light or infrared radiation), the "stored" energy is then released as an emission of visible or infrared radiation. BaFBr described herein is such a storage phosphor.

For example, useful phosphors are described in numerous references relating to fluorescent intensifying screens, including but not limited to, *Research Disclosure,* Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP 0 491 116A1 (Benzo et al.), the disclosures of all of which are incorporated herein by reference with respect to the phosphors.

Useful classes of phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described for example in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference. These include rare earth-activated lanthanum oxybromides, and terbium-activated or thulium-activated gadolinium oxides such as $Gd_2O_2S$:Tb.

Other suitable phosphors are described in U.S. Pat. No. 4,835,397 (Arakawa et al.) and U.S. Pat. No. 5,381,015 (Dooms), both incorporated herein by reference, and including for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another useful class of phosphors includes rare earth hosts that are rare earth activated mixed alkaline earth metal sulfates such as europium-activated barium strontium sulfate.

Thus, one class of useful phosphors include rare earth oxychalcogenides and halide phosphors represented by the following formula (1):

$$M'_{(w-n)}M''_nO_wX'' \quad (1)$$

wherein M' is at least one of the metals yttrium (Y), lanthanum (La), gadolinium (Gd), or lutetium (Lm), M" is at least one of the rare earth metals dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), X" is a middle chalcogen (S, Se, or Te) or halogen, n is 0.002 to 0.2, and w is 1 when X" is halogen or 2 when X" is a middle chalcogen.

Another useful class of phosphors include phosphors that are the products of firing starting materials comprising optional oxide and a combination of species characterized by the following formula (2):

$$MFX_{1-z}I_zuM^aX^a:yA:eQ:tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni), "z" is 0 to 1, "u" is from 0 to 1, "y" is from $1\times10^{-4}$ to 0.1, "e" is from 0 to 1, and "t" is from 0 to 0.01.

Still another useful class of phosphors includes phosphors that are divalent alkaline earth metal fluorohalide phosphors characterized by the following formula (3):

$$(Ba_{1-a-b-c}Mg_aCa_bSr_c)FX_{1-z}I_zrM^aX^a:yA \quad (3)$$

wherein "M" is magnesium (Mg), calcium (Ca), strontium (Sr), or barium (Ba), "F" is fluoride, "X" is chloride (Cl) or bromide (Br), "I" is iodide, Ma is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Th), "z" is 0 to 1, "y" is from $1\times10^{-4}$ to 0.1, the sum of a, b and c is from 0 to 4, and r is from $10^{-6}$ to 0.1.

Particularly useful phosphors are those containing doped or undoped tantalum such as $YTaO_4$, $YTaO_4$:Nb, Y(Sr)$TaO_4$, and Y(Sr)$TaO_4$:Nb. These phosphors are described in U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), all incorporated herein by reference. Other useful phosphors are alkaline earth metal phosphors.

Storage phosphors can also be used in the practice of this invention. Various storage phosphors are described for example, in U.S. Pat. No. 5,464,568 (noted above), incorporated herein by reference. Such phosphors include divalent alkaline earth metal fluorohalide phosphors that may optionally contain iodide. Some embodiments of these phosphors are described in more detail in U.S. Pat. No. 5,464,568 (noted above). Still other storage phosphors are described in U.S. Pat. No. 4,368,390 (Takahashi et al.), incorporated herein by reference, and include divalent europium and other rare earth activated alkaline earth metal halides and rare earth element activated rare earth oxyhalides, as described in more detail above.

Examples of useful phosphors include: SrS:Ce,SM, SrS:Eu,Sm, $ThO_2$:Er, $La_2O_2S$:Eu,Sm, ZnS:Cu,Pb, and others described in U.S. Pat. No. 5,227,253 (Takasu et al.), incorporated herein by reference.

The one or more phosphors used in the practice of this invention are present in the photothermographic materials in an amount of at least 0.1 mole per mole, and preferably from about 0.5 to about 20 mole, per mole of total silver in the photothermographic material. Generally, the amount of total silver is at least 0.002 mol/$M^2$.

Because of the size of the phosphors used in the invention, generally the layers in which they are incorporated (usually one or more emulsion layers), have a dry coating weight of at least 5 g/$m^2$, and preferably from about 5 g/$m^2$, to about 200 g/$m^2$. Most preferably, the one or more phosphors and the photosensitive silver halide are incorporated within the same imaging layer that has a dry coating weight within the noted preferred range.

Binders

The chemically sensitized photosensitive silver halide, the non-photosensitive source of reducible silver ions, the reducing agent composition described above, and any other imaging layer additives used in the present invention are generally combined with one or more binders that are either hydrophilic or hydrophobic. Thus, either aqueous or organic solvent-based formulations can be used to prepare the thermally developable materials of this invention. Mixtures of either or both types of binders can also be used. It is preferred that the binder be selected from hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available under the names BUTVAR® (Solutia, Inc.) and PIOLOFORM® (Wacker Polymer Systems).

Aqueous dispersions (or latexes) of hydrophobic binders may also be used either alone as binders or in combination with other binders.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure,* item 38957, noted above). Cationic starches can be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example, in EP 0 600 586B1 (Philip, Jr. et al.), vinyl sulfone compounds as described in U.S. Pat. No. 6,143,487 (Philip, Jr. et al.), and EP 0 640 589A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The*

*Theory of the Photographic Process,* Fourth Edition, Eastman Kodak Company, Rochester, N.Y., 1977, Chapter 2, pp. 77–78.

Where the proportions and activities of the photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. The effective range of the amount of polymer can be appropriately determined by one skilled in the art. Preferably, a binder is used at a level of about 10% by weight to about 90% by weight, and more preferably at a level of about 20% by weight to about 70% by weight, based on the total dry weight of the layer in which it is included. The amount of binders in double-sided photothermographic materials may be the same or different.

It is particularly useful in the photothermographic materials of this invention to use predominantly (more than 50% by weight of total binder weight) hydrophobic binders in both imaging and non-imaging layers on both sides of the support. Thus, the hydrophobic binder is mixed into the photothermographic emulsion prepared according to this invention to form a photothermographic emulsion formulation for coating onto a support.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure,* August 1979, item 18431. A method of making dimensionally stable polyester films is described in *Research Disclosure,* September 1999, item 42536. Support materials may also be treated or annealed to reduce shrinkage and promote dimensional stability.

It is also useful to use supports comprising dichroic mirror layers wherein the dichroic mirror layer reflects radiation at least having the predetermined range of wavelengths to the emulsion layer and transmits radiation that has wavelengths outside the predetermined range of wavelengths. Such dichroic supports are described in U.S. Pat. No. 5,795,708 (Boutet), incorporated herein by reference.

It is further useful to use transparent, multilayer, polymeric supports comprising numerous alternating layers of at least two different polymeric materials. Such multilayer polymeric supports preferably reflect at least 50% of actinic radiation in the range of wavelengths to which the photothermographic material is sensitive, and provide photothermographic materials having increased speed. Such transparent, multilayer, polymeric supports are described in U.S. Pat. No. 6,630,283 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. For example, blue-tinted supports are particularly useful for providing images useful for medical diagnosis. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The present invention also provides a method for preparing photothermographic materials. This method includes the steps (A) through (D), and optionally step (E) described above in relation to the method of making a photothermographic emulsion (and in the various orders noted above). In general, preparing the photothermographic material involves at least steps (A) through (D), followed by:

(E') simultaneously with any of steps (B) through (D), or subsequently to step (D), adding a binder to form an emulsion formulation, and (F) after step (E'), coating and drying the emulsion formulation on a support to provide a photothermographic imaging material.

Preferably, these steps are carried out in the order of step (A), step (B), step (C), step (D), step (E'), and step (F). It is also possible for steps (B) and (D) to be carried out simultaneously. A reducing agent composition can also be added to the photothermographic emulsion at any suitable point. As noted above, step (E) can be used wherein some of the reducible silver ions in the non-photosensitive source of reducible silver ions are converted into photosensitive silver halide grains by addition of an inorganic or an organic halide (such as lithium bromide, calcium bromide, or zinc bromide).

Thus, in some embodiments, the steps are carried out in the order of step (A), step (B), step (C), step (D), step (E), step (E'), and step (F). Alternatively, the method steps can be carried out in the order of step (A), step (B), step (D), step (C), step (E'), and step (F), or in the order of step (A), step (D), step (B), step (C), step (E'), and step (F).

An organic solvent-based coating formulation for the photothermographic emulsion layer(s) can be prepared by mixing the photothermographic emulsion prepared according to the present invention with one or more binders, the reducing composition, toner(s), and optional addenda in a suitable solvent system that usually includes an organic solvent, such as toluene, 2-butanone (methyl ethyl ketone), acetone, or tetrahydrofuran, or mixtures thereof.

Alternatively, the desired imaging components can be formulated with a hydrophilic binder (such as gelatin, a gelatin-derivative, or a latex) in water or water-organic solvent mixtures to provide aqueous-based coating formulations.

Photothermographic materials of the invention can contain plasticizers and lubricants such as poly(alcohols) and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials of this invention can include one or more antistatic agents in any of the layers including the photothermographic emulsion layer, or in separate conductive layers, on either or both sides of the support. Thus, conductive components include, but are not limited to, soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776 A1 (Melpolder et al.). Particularly useful conductive particles are the non-acicular metal antimonate particles described in U.S. Pat. No. 6,689,546 (LaBelle et al.). All of the above patents and patent applications are incorporated herein by reference. Other antistatic agents are well known in the art.

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms. These antistatic compositions are described in more detail in U.S. Published Application 2003-0198901 (Sakizadeh et al.) that is incorporated herein by reference.

Additional conductive compositions include one or more fluoro-chemicals having the structure $R_f$—R—$N(R'_1)(R'_2)(R'_3)^+X^-$ wherein $R_f$ is a straight or branched chain perfluoroalkyl group having 4 to 18 carbon atoms, R is a divalent linking group comprising at least 4 carbon atoms and a sulfide group in the chain, $R'_1$, $R'_2$, $R'_3$ are independently hydrogen or alkyl groups or any two of $R'_1$, $R'_2$, and $R'_3$ taken together can represent the carbon and nitrogen atoms necessary to provide a 5- to 7-membered heterocyclic ring with the cationic nitrogen atom, and $X^-$ is a monovalent anion. These antistatic compositions are described in more detail in U.S. Pat. No. 6,762,013 (Sakizadeh et al.) that is incorporated herein by reference.

The photothermographic materials of this invention can be constructed of one or more layers on the imaging side of the support. Single layer materials should contain the chemically sensitized silver halide, the non-photosensitive source of reducible silver ions, the reducing agent composition, the binder, as well as optional materials such as toners, acutance dyes, coating aids, and other adjuvants.

Two-layer constructions comprising a single imaging layer coating containing all the ingredients and a surface protective topcoat are generally found on the frontside of the materials of this invention. However, two-layer constructions containing the chemically sensitized silver halide, and non-photosensitive source of reducible silver ions in one imaging layer (usually the layer adjacent to the support) and the reducing composition and other ingredients in the second imaging layer or distributed between both layers are also envisioned.

For double-sided photothermographic materials, each side of the support can include one or more of the same or different imaging layers, interlayers, and protective topcoat layers. In such materials preferably a topcoat is present as the outermost layer on both sides of the support. The thermally developable layers on opposite sides can have the same or different construction and can be overcoated with the same or different protective layers. The polycarboxylic acid compound(s) can be the same or different on opposite sides of the support.

Layers to promote adhesion of one layer to another in photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), and in U.S. Pat. No. 6,667,148 (Rao et al.), and U.S. Pat. No. 6,746,831 (Hunt), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

For example, after or simultaneously with application of the photothermographic emulsion formulation to the support, a protective overcoat formulation can be applied over the emulsion formulation. Preferably, the two formulations are applied simultaneously.

In other embodiments, a "carrier" layer formulation comprising a single-phase mixture of the two or more polymers described above may be applied directly onto the support and thereby located underneath the emulsion layer(s). Such formulations are described in U.S. Pat. No. 6,355,405 (Ludemann et al.), incorporated herein by reference. Preferably, the carrier layer formulation is applied to the support simultaneously with application of the photothermographic emulsion layer formulation.

Mottle and other surface anomalies can be reduced in the photothermographic materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layer formulations are applied to a film support using slide coating. The first layer can be coated on top of the second layer while the second layer is still wet. The first and second fluids used to coat these layers can be the same or different solvents (or solvent mixtures).

While the first and second layers can be coated on one side of the film support, manufacturing methods can also include forming on the opposing or backside of the polymeric support, one or more additional layers, including a conductive layer, an antihalation layer, or a layer containing a matting agent (such as silica), or a combination of such layers. Alternatively, one backside layer can perform all of the desired functions.

It is also contemplated that the photothermographic materials of this invention can include photothermographic emulsion layers on both sides of the support and/or at least one infrared radiation absorbing heat-bleachable composition as an antihalation underlayer beneath at least one emulsion layer.

Photothermographic materials having thermally developable layers disposed on both sides of the support often suffer from "crossover." Crossover results when radiation used to image one side of the photothermographic material is transmitted through the support and images the photothermographic layers on the opposite side of the support. Such radiation causes a lowering of image quality (especially sharpness). As crossover is reduced, the sharper becomes the image. Various methods are available for reducing crossover. Such "anti-crossover" materials can be materials specifically included for reducing crossover or they can be acutance or antihalation dyes. In either situation, when imaged with visible radiation, it is often necessary that they be rendered colorless during processing.

To promote image sharpness, photothermographic materials prepared by the present invention can contain one or more layers containing acutance and/or antihalation dyes. These dyes are chosen to have absorption close to the exposure wavelength and are designed to absorb scattered light. One or more antihalation compositions may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation composition on the backside of the support, and more preferably in the backside conductive layer.

Dyes useful as antihalation, filter, crossover prevention (anti-crossover), anti-irradiation and/or acutance dyes include squaraine dyes described in U.S. Pat. No. 5,380,635 (Gomez et al.), U.S. Pat. No. 6,063,560 (Suzuki et al.), U.S. Pat. No. 6,432,340 (Tanaka et al.), U.S. Pat. No. 6,444,415 (Tanaka et al.), and EP 1 083 459 A1 (Kimura), the indolenine dyes described in EP 0 342 810 A1 (Leichter), and the cyanine dyes described in U.S. Published Application 2003-0162134 (Hunt et al.). All of the above documents are incorporated herein by reference.

It is also useful to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566B2, (Sakurada et al.), U.S. Published Application 2001-0001704 (Sakurada et al.), JP Kokai 2001-142175 (Hanyu et al.), and JP Kokai 2001-183770 (Hanye et al.). Also useful are bleaching compositions described in JP Kokai 11-302550 (Fujiwara), JP Kokai 2001-109101 (Adachi), JP Kokai 2001-51371 (Yabuki et al.), and JP Kokai 2000-029168 (Noro). All of the above publications are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

In some preferred embodiments, the photothermographic materials of this invention include a surface protective layer over one or more imaging layers one both sides of the support.

In other preferred embodiments, the photothermographic materials include a surface protective layer on the same side of the support as the one or more photothermographic emulsion layers and a layer on the backside that includes an antihalation composition and/or conductive antistatic components. A separate backside surface protective layer can also be included in these embodiments.

Imaging/Development

The photothermographic materials of the present invention can be imaged in any suitable manner consistent with the type of material by using any suitable imaging source (typically some type of radiation or electronic signal). In some embodiments, the materials are sensitive to radiation in the range of from about at least 300 nm to about 1400 nm, and preferably from about 300 nm to about 850 nm.

Imaging can be achieved by exposing the photothermographic materials of this invention to a suitable source of radiation to which they are sensitive, including ultraviolet radiation, visible light, near infrared radiation, and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure,* September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5.493,327 (McCallum et al.).

In some embodiments, the photothermographic materials of the present invention can be imaged using any suitable X-radiation imaging source to provide a latent image. Suitable exposure means are well known and include medical, mammography, dental, and industrial X-ray units.

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath. A preferred heat development procedure includes heating at from about 110° C. to about 135° C. for from about 3 to about 25 seconds.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

In another two-step development method, thermal development can take place using a preheating step (for example at about 110° C. for up to 10 seconds), immediately followed by a final development step (for example at about 125° C. for up to 20 seconds).

Use as a Photomask

The photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials and subsequent development affords a visible image. The heat-developed photothermographic materials absorb ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

Thus, a method for the formation of a visible image (usually a black-and-white image) comprises:

A) imagewise exposing the photothermographic material of this invention to electromagnetic radiation to which the chemically sensitized silver halide is sensitive, to form a latent image, and B) simultaneously or sequentially, heating the exposed material to develop the latent image into a visible image.

The photothermographic material may be exposed in step A using any source of radiation, to which it is sensitive, including: ultraviolet radiation, visible light, infrared radiation or any other infrared radiation source readily apparent to one skilled in the art.

This visible image prepared from a photothermographic material can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the heat-developed photothermographic material. Thus, in some other embodiments wherein the photothermographic material comprises a transparent support, the image-forming method further comprises:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

Imaging Assemblies

The photothermographic materials described herein are also useful in an imaging assembly comprising one or more phosphor intensifying screens adjacent the front and/or back of the photothermographic material. Such screens are well known in the art [for example, U.S. Pat. No. 4,865,944 (Roberts et al.) and U.S. Pat. No. 5,021,327 (Bunch et al.)]. An assembly (often known as a cassette), can be prepared by arranging the photothermographic material, and the one or more screens in a suitable holder and appropriately packaging them for transport and imaging uses.

In use, the phosphor intensifying screen can be positioned in "front" of the photothermographic material to absorb X-radiation and to emit electromagnetic radiation having a wavelength greater than 300 nm and to which the photothermographic material has been sensitized.

Double-coated X-radiation sensitive photothermographic materials (that is, materials having one or more thermally developable imaging layers on both sides of the support) are preferably used in combination with two intensifying screens, one screen in the "front" and one screen in the "back" of the material. The front and back screens can be appropriately chosen depending upon the type of emissions desired, the desired photicity, emulsion speeds, and percent crossover. A metal (such as copper or lead) screen can also be included if desired.

Other arrangements of screens and photothermographic materials in imaging assemblies or cassettes would be readily apparent to a skilled artisan. Constructions and imaging assemblies useful in industrial radiography include, for example, U.S. Pat. No. 4,480,024 (Lyons et al), U.S. Pat. No. 5,900,357 (Feumi-Jantou et al.), and EP 1 350 883 A1 (Pesce et al.).

The following examples are provided to illustrate the practice of the present invention and the invention is not meant to be limited thereby.

MATERIALS AND METHODS FOR THE EXPERIMENTS AND EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID® A-21 is an acrylic copolymer available from Rohm and Haas (Philadelphia, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co. (Kingsport, Tenn.).

DESMODUR™ N3300 is an aliphatic hexamethylene diisocyanate that is available from Bayer Chemicals (Pittsburgh, Pa.).

Diphenylphosphine sulfide (DPPS) was obtained from Organometallics, Inc (East Hampstead, N.H.)

PERMANAX® WSO (or NONOX®) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

PIOLOFORM® BM-18 and PIOLOFORM® BL-16 are polyvinyl butyral resins available from Wacker Polymer Systems (Adrian, Mich.).

MEK is methyl ethyl ketone (or 2-butanone).

PHP is pyridinium hydrobromide perbromide.

The Fischer X-Ray machine was a Model 36600G and was obtained from Fischer Imaging Corporation (Denver, Colo.).

The X-Rite® Model 301 densitometer was obtained from X-Rite Inc. (Grandville, Mich.).

Vinyl Sulfone-1 (VS-1) is described in U.S. Pat. No. 6,143,487 and is believed to have the structure shown below.

(VS-1)

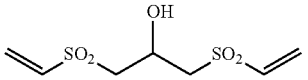

Antifoggant-A is tribromomethylsulfonylpyridine. It is believed to have the structure shown below.

(AF-A)

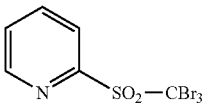

Ethyl-2-cyano-3-oxobutanoate (Antifoggant-B) is described in U.S. Pat. No. 5,686,228 and is believed to have the structure shown below.

(AF-B)

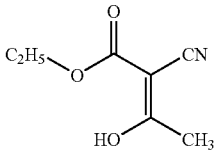

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

(BC-1)

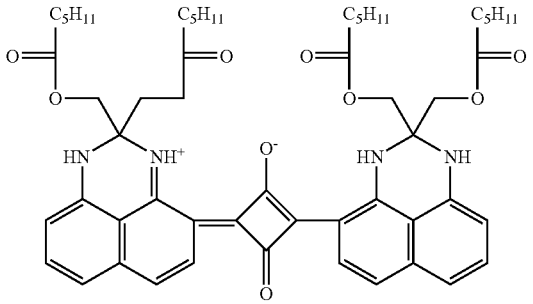

Compound CN-08 is described in U.S. Pat. No. 5,545,515 (Murray et al.) and is believed to have the structure shown below.

(CN-08)

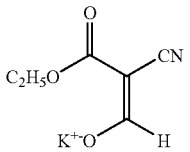

Compound S-1 is a sulfur-containing chemical sensitizing dye and is believed to have the structure shown below.

(S-1)

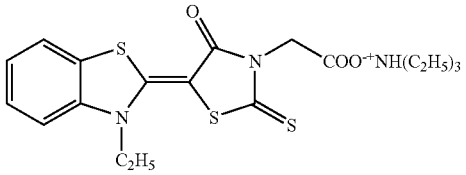

Comparative Compound C-1 is described in JP Kokai 2002-250984 (Kimura) and is believed to have the structure shown below.

(C-1)

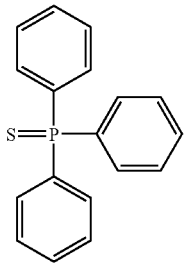

Synthesis of Substituted Diphenylphosphine Sulfides:

N,N-Diethylcarbamoylmethyl-diphenylphosphine sulfide (PS-1). A stirred mixture of diphenylphosphine sulfide (4.365 g, 0.02 mol) and N,N-diethylchloroacetamide (4.189 g, 0.028 mol) in methylene chloride (80 ml) was cooled to 8–10° C. in an ice-water bath. Small pieces of solid potassium hydroxide (3.927 g, 0.07 mol) were added while stirring under nitrogen atmosphere. After 30 minutes, water (25 ml) was added and the organic layer was separated, washed with more water (25 ml) and dried over sodium sulfate. The solvent was removed under reduced pressure using a rotary evaporator and the oily residue was crystallized from ethyl acetate-hexane mixture to give 3.5 g (53%) of large cubes. mp: 108–110° C.

Phenylcarbonylmethyl-diphenylphosphine sulfide (PS-2).

A stirred mixture of diphenylphosphine sulfide (0.218 g, 0.001 mol) and chloroacetophenone (0.216 g, 0.0014 mol) in methylene chloride (4 ml) was cooled to 8–10° C. in an ice-water bath. Small pieces of solid potassium hydroxide (0.196 g, 0.0035 mol) were added while stirring under nitrogen atmosphere. After 45 minute, water (2 ml) was added and the organic layer was separated, washed with more water (2 ml) and dried over sodium sulfate. The solvent was removed under reduced pressure using a rotary evaporator and the oily residue was crystallized from ethyl acetate-hexane mixture to give 0.19 g (56.5%) of star shaped crystals. mp=83–84° C.

(4'-Fluoropropiophenone) diphenylphosphine sulfide (PS-13).

A stirred mixture of diphenylphosphine sulfide (1.09 g, 0.005 mol) and 2-chloro-4'-fluoropropiophenone (Matrix Scientific, Columbia, S.C.) (1.03 g, 0.0055 mol) in methylene chloride (25 ml) were cooled to 0° C. While stirring under nitrogen blanket, powdered potassium hydroxide (0.98 g, 0.0175 mol) was added at once. Cooling was removed, the reaction was allowed to warm to room temperature, and stirring was continued. The mixture turned cloudy after 30 minutes. Stirring was continued for 16 hours during which time the color of reaction turned orange. TLC (in hexanes) showed complete disappearance of the dipenylphosphine sulfide and formation of only one major product. The reaction mixture was washed with water (2×25 ml) and dried over sodium sulfate. Methylene chloride was removed under reduced pressure using a rotary evaporator and the yellow crystalline residue was recrystallized from ethyl acetate-hexane followed by refrigeration to afford 0.97 g (53%) of product. m.p.=134–135° C.

Other (PS) compounds were prepared in a similar manner. All of the compounds were characterized from their IR, $^1$H-NMR, and MS spectra.

Example 1

Use in Photothermographic Materials

The preparation of a photothermographic formulation was carried out as follows:

A preformed silver bromide, silver carboxyl ate "soap" dispersion was prepared as described in U.S. Pat. No. 6,413,710 (Shor et al.). The average grain size was 0.14 μm.

Photothermographic Emulsion Formulation:

Chemically sensitized photothermographic emulsions were prepared according to procedures described in U.S. Pat. No. 6,423,481 (Simpson et al.) but incorporating the sulfur-containing compounds of this invention and using the materials and amounts shown below. The materials were added 10 to 60 minutes apart and the temperature during addition ranged from 50° F. to 70° F. (10° C. to 21° C.).

To 199.3 g of this silver soap dispersion at 23.9% solids was added in order:

| Chemical Sensitizer | Amount indicated in TABLE I* |
|---|---|
| Zinc Bromide | 0.169 g in 1.19 g of MeOH |
| PHP | 0.20 g in 1.58 g of MeOH |
| Au-2 | 4.8 ml of a solution of 0.0052 g in 50 g of MeOH |
| Chlorobenzoyl benzoic acid | 1.42 g |
| BUTVAR B-79 | 20 g |
| Antifoggant-A | 2.14 g in 24.2 g of MEK |
| DESMODUR ™ N3300 | 0.63 g in 1.5 g of MEK |
| Phthalazine | 1.0 g in 5 g of MEK |
| Tetrachlorophthalic acid | 0.35 g in 2 g of MEK |
| 4-Methylphthalic acid | 0.45 g in 4 g of MEK |
| PERMANAX ® WSO | 10.6 g |

*A $1.53 \times 10^{-4}$ mol solution of PS compound was prepared in 8.64 g of MEK, methanol, or a mixture thereof. Choice of solvents was determined by solubility.

Protective Topcoat Formulation:

A protective topcoat for the photothermographic emulsion layer was prepared as follows:

| | |
|---|---|
| ACRYLOID ® A-21 | 0.58 g |
| CAB 171-15S | 14.9 g |
| MEK | 200 g |
| VS-1 | 0.3 g |
| Benzotriazole | 1.6 g |
| Antifoggant-A | 0.24 g |
| Antifoggant-B | 0.12 g |

The photothermographic emulsion and topcoat formulations were coated under safelight conditions using a dual knife coating machine onto a 7 mil (178 μm) blue-tinted polyethylene terephthalate support provided with a backside antihalation layer containing Dye BC-1 in CAB 171-15S resin binder. Samples were dried for 7 minutes at 87° C. The silver coating weights were approximately 2.2 to 2.3 g/m$^2$.

Samples of the photothermographic materials were imagewise exposed for $10^{-3}$ seconds using an EG&G Flash sensitometer equipped with both a P-16 filter and a 0.7 neutral density filter to provide continuous tone "wedges." Following exposure, the films were developed using a heated roll processor for 15 seconds at 122.2° C. to 122.8° C.

Densitometry measurements were made on a custom built computer-scanned densitometer and meeting ISO Standards 5-2 and 5-3. They are believed to be comparable to measurements from commercially available densitometers. Density of the wedges was then measured with a computer densitometer using a filter appropriate to the sensitivity of the photothermographic material to obtain graphs of density versus log exposure (that is, D log E curves).

Emulsion formulations were made with compounds PS-1, PS-2, PS-3, and PS-4. Comparative formulations were also prepared. The sensitometric results, shown below in TABLE I demonstrate the increase in speed when the PS compounds of this invention are formulated along with gold(III) compounds. Only a small increase in Drain was found.

TABLE I

| Example | PS Compound | Amount PS Compound | Au-2 Used | $D_{min}$ | SP-2 | AC-1 | AC-2 |
|---|---|---|---|---|---|---|---|
| Comparative 1-1 | None | None | None | 0.25 | 2.71 | 3.28 | 2.36 |
| Comparative 1-2 | None | None | Yes | 0.25 | 2.54 | 3.32 | 2.44 |
| Invention 1-1 | PS-1 | 7.9 ml | Yes | 0.29 | 3.95 | 2.95 | 1.93 |
| Invention 1-2 | PS-2 | 5.9 ml | Yes | 0.31 | 4.16 | 3.40 | 2.81 |
| Invention 1-3 | PS-2 | 4.0 ml | Yes | 0.29 | 3.43 | 2.17 | 1.51 |
| Invention 1-4 | PS-3 | 7.9 ml | Yes | 0.29 | 3.53 | 1.94 | 1.56 |
| Invention 1-5 | PS-4 | 6.0 ml | Yes | 0.26 | 3.84 | 3.34 | 2.55 |

Example 2

Use in Phosphor-Containing Photothermographic Materials

To 25 g of each of the photothermographic emulsion formulations prepared above in Example 1, was added 18.2 g of $YSrTaO_4$ phosphor having an average size of 4.0 μm. The materials were mixed for 15 minutes to prepare the final photothermographic coating formulations. Photothermographic materials were coated and dried as described in Example 1. The approximate phosphor coating weights were from 79 to 82 g/$m^2$.

The photothermographic materials were imaged, developed, and evaluated as described above in Example 1. The sensitometric results, shown below in TABLE II, demonstrate the increase in speed when the (PS) compounds of this invention are formulated along with gold(III) compounds in a phosphor-containing photothermographic material.

TABLE II

| Example | PS Compound | Amount PS Compound | Au-2 Used | $D_{min}$ | SP-2 | AC-1 | AC-2 |
|---|---|---|---|---|---|---|---|
| Comparative 2-1 | None | None | None | 0.64 | 2.88 | 4.37 | 5.09 |
| Comparative 2-2 | None | None | Yes | 0.64 | 2.75 | 4.62 | 5.33 |
| Invention 2-1 | PS-1 | 7.9 ml | Yes | 0.88 | 4.24 | 3.63 | 4.21 |
| Invention 2-2 | PS-2 | 5.9 ml | Yes | 0.96 | 4.48 | 3.69 | 4.41 |
| Invention 2-3 | PS-2 | 4.0 ml | Yes | 0.81 | 3.85 | 2.87 | 3.04 |
| Invention 2-4 | PS-3 | 7.9 ml | Yes | 0.85 | 3.94 | 2.63 | 2.95 |
| Invention 2-5 | PS-4 | 6.0 ml | Yes | 0.75 | 4.25 | 3.94 | 4.64 |

The X-ray sensitometric response of these photothermographic materials was determined by exposing the samples using a Fischer X-ray unit operating at 200 mA and 76 KeV and filtered with a 3.0 mm sheet of aluminum. The samples were placed on a table set at 85.5 cm from the X-ray source. A series of X-ray exposures of constant intensity and exposure times from 0.1 sec to 1.5 sec were made. Exposed samples were developed in a manner similar to that described in Example 1.

The density of these samples were measured with a X-Rite® 310 densitometer using the Status A filters and measured with the visible filter. The sensitometric results, shown below in TABLE III, demonstrate the increase in sensitivity to X-rays when the (PS) compounds of this invention are formulated along with gold(III) compounds in a phosphor-containing photothermographic material. TABLE III also shows the materials had good differentiation between developed density and Dmin. In addition, D log E curves showed low Dmin, and good speed and contrast.

TABLE III

| Example | (Developed Density − $D_{min}$) at 0.8 sec | (Developed Density − $D_{min}$) at 1.5 sec |
|---|---|---|
| Comparative 2-1 | 0.00 | 0.00 |
| Comparative 2-2 | 0.00 | 0.00 |
| Invention 2-1 | 1.05 | 1.93 |
| Invention 2-2 | 3.22 | 3.79 |
| Invention 2-3 | 0.34 | 0.71 |
| Invention 2-4 | 0.51 | 1.03 |
| Invention 2-5 | ** | ** |

** not measured

Example 3

Use in Phosphor-Containing High-Contrast Photothermographic Materials

Photothermographic materials were prepared, imaged and developed as described in Example 2 except that to 25 g of each of the photothermographic emulsions was also added 0.4 ml of a solution prepared by dissolving 0.43 g of high-contrast agent, compound CN-08, in 7.4 g of methanol. The sensitometric results, shown below in TABLE IV, demonstrate the increase in speed when the (PS) compounds of this invention are formulated along with gold(III) compounds in a phosphor-containing high-contrast photothermographic material.

TABLE IV

| Example | PS Compound | Amount PS Compound | Au-2 used | $D_{min}$ | SP-2 | AC-1 | AC-2 |
|---|---|---|---|---|---|---|---|
| Comparative 3-1 | None | None | Yes | 0.61 | 2.80 | 4.55 | 5.38 |
| Invention 3-1 | PS-1 | 7.9 ml | Yes | 0.73 | 4.13 | 3.72 | 5.19 |

The sensitometric X-ray response was also measured as described in Example 2. The sensitometric response after X-ray exposure, shown below in TABLE V demonstrates that significant X-ray sensitivity was obtained by addition of the chemical sensitizer (PS) compounds of this invention in combination with gold(III) sensitized emulsions containing the high-contrast agent, CN-08. TABLE V also shows the materials had good differentiation between developed density and Dmin. In addition, D log E curves showed low Dmin, and good speed and contrast.

TABLE V

| Example | (Developed Density − $D_{min}$) at 0.8 sec | (Developed Density − $D_{min}$) at 1.5 sec |
|---|---|---|
| Comparative 3-1 | 0.00 | 0.00 |
| Invention 3-1 | 0.51 | 1.03 |

Examples 4–7

Examples 4–7 demonstrate the use of the PS compounds in photothermographic emulsions having a silver halide with an average grain size of 0.20 μm.

Example 4

Use in Photothermographic Materials

The preparation of a photothermographic formulation was carried out as follows:

A preformed silver bromide, silver carboxylate "soap" dispersion was prepared as described in U.S. Pat. No. 6,413,710 (Shor et al.). The average grain size was 0.20 μm.

Chemically sensitized photothermographic emulsions were prepared according to procedures described in U.S. Pat. No. 6,423,481 (Simpson et al.) but incorporating the PS compounds of this invention and using the materials and amounts as described in Example 1.

Emulsion formulations were made with compounds PS-1 and PS-4. Comparative formulations were also prepared. Samples were coated, dried, imaged, and developed as described above in Example 1. The sensitometric results, shown below in TABLE VI, demonstrate the increase in speed when the PS compounds of this invention are formulated along with gold(III) compounds. Only a small increase in Dmin was found.

TABLE VI

| Example | PS Compound | Amount PS Compound | Au-2 Used | $D_{min}$ | SP-2 | AC-1 | AC-2 |
|---|---|---|---|---|---|---|---|
| Comparative 4-1 | None | None | None | 0.37 | 2.73 | 1.56 | 1.23 |
| Comparative 4-2 | None | None | Yes | 0.46 | 2.74 | 1.35 | 0.89 |
| Invention 4-1 | PS-1 | 8.2 ml | Yes | 0.42 | 4.26 | 1.71 | 1.157 |
| Invention 4-2 | PS-2 | 6.0 ml | Yes | 0.39 | 3.95 | 2.43 | 1.71 |
| Invention 4-3 | PS-4 | 6.6 ml | Yes | 0.42 | 4.15 | 2.48 | 1.64 |

Example 5

Use in Phosphor-Containing Photothermographic Materials

To 25 g aliquots of each of the photothermographic emulsion formulations prepared above in Example 4, was added 18.2 g of $YSrTaO_4$ phosphor having an average size of 4.0 μm. The materials were mixed for 5 minutes to prepare the final photothermographic coating formulations. Comparative formulations were also prepared. Photothermographic materials were coated and dried as described in Example 1. The approximate phosphor coating weights were from 78 to 82 g/$m^2$.

The photothermographic materials were imaged, developed, and evaluated as described above in Example 1. The sensitometric results, shown below in TABLE VII, demonstrate the increase in speed when the (PS) compounds of this invention are formulated along with gold(III) compounds in a phosphor-containing photothermographic material.

TABLE VII

| Example | PS Compound | Amount PS Compound | Au-2 used | $D_{min}$ | SP-2 | AC-1 | AC-2 |
|---|---|---|---|---|---|---|---|
| Comparative 5-1 | None | None | None | 0.89 | 3.10 | 2.71 | 2.81 |
| Comparative 5-2 | None | None | Yes | 1.19 | 3.05 | 2.54 | 2.62 |
| Invention 5-1 | PS-1 | 8.2 ml | Yes | 1.05 | 4.55 | 3.17 | 3.49 |

TABLE VII-continued

| Example | PS Compound | Amount PS Compound | Au-2 used | $D_{min}$ | SP-2 | AC-1 | AC-2 |
|---|---|---|---|---|---|---|---|
| Invention 5-2 | PS-2 | 6.0 ml | Yes | 1.22 | 4.30 | 3.00 | 3.56 |
| Invention 5-3 | PS-4 | 6.6 ml | Yes | 1.10 | 4.48 | 3.25 | 3.68 |

The X-ray sensitometric response of these photothermographic materials was determined by exposing the samples using a Fischer X-ray unit operating at 200 mA and 76 KeV filtered with a 3.0 mm sheet of aluminum. The samples were placed on a table set at 85.5 cm from the X-ray source. A series of X-ray exposures of constant intensity and exposure times of from 0.1 sec to 1.5 sec was made. After samples were exposed they were processed in a manner similar as described in Example 1.

The density of these samples were measured with a X-Rite® 310 densitometer using the Status A filters and measured with the visible filter. The sensitometric results, shown below in TABLE VIII, demonstrate the increase in sensitivity to X-rays when the (PS) compounds of this invention are formulated along with gold(III) compounds in a phosphor-containing photothermographic material. TABLE VIII also shows the materials had good differentiation between developed density and Dmin. In addition, D log E curves showed low Dmin, and good speed and contrast.

TABLE VIII

| Example | (Developed Density − $D_{min}$) at 0.8 sec | (Developed Density − $D_{min}$) at 1.5 sec |
|---|---|---|
| Comparative 5-1 | 0.04 | 0.11 |
| Comparative 5-2 | 0.05 | 0.10 |
| Invention 5-1 | 2.92 | 3.16 |
| Invention 5-2 | 2.88 | 3.40 |
| Invention 5-3 | 2.94 | 3.30 |

Example 6

Use in Photothermographic Materials

A comparison of photothermographic materials incorporating compound PS-1 and Au-2 with compound S-1, a known sulfur sensitizer described in U.S. Pat. No. 5,891,615 (Winslow et al.) and Au-2 is shown below.

Photothermographic emulsions were prepared, as described in Example 1 except that 7.9 ml of PS-1 solution and 1.48 g of Antifoggant-A in 16.72 g of MEK was used in the photothermographic emulsion formulation, and no Antifoggant A was added to the topcoat formulation.

The sample containing compound S-1 was prepared by adding a solution containing 0.02 g of compound S-1 in 2.5 g of methanol and 2.5 g of MEK in place of compound PS-1. In addition, the $ZnBr_2$ was added after the PHP addition.

Samples were coated, dried, imaged, and developer as described in Example 1. The silver coating weights were from 2.34 to 2.39 g/m$^2$.

The sensitometric results, shown below in TABLE IX, demonstrate that both constructions have similar photospeeds. However, the sample containing compound PS-1 had both lower Dmin and higher contrast than the sample containing compound S-1, even though compound PS-1 was present at 2.5 molar equivalents to compound S-1.

TABLE IX

| Example | Moles of S-1 | Moles of PS-1 | Au-2 Used | $D_{min}$ | SP-2 | AC-1 | AC-2 |
|---|---|---|---|---|---|---|---|
| Comparative 6-1 | $4.41 \times 10^{-5}$ | None | Yes | 0.34 | 4.32 | 3.13 | 2.54 |
| Invention 6-1 | None | $1.12 \times 10^{-4}$ | Yes | 0.31 | 4.28 | 3.60 | 2.76 |

These materials were then aged at ambient temperatures and humidity and the sensitometry was measured again after 12.7 weeks. The changes in Dmin, SP-2, AC-1 and AC-2 after 12.7 weeks, shown below in TABLE X, demonstrate that the photothermographic material containing compound PS-1 shows improved Dmin and contrast aging as compared to known chemical sensitizer S-1.

TABLE X

| Example | $\Delta D_{min}$ | ΔSP-2 | ΔAC-1 | ΔAC-2 |
|---|---|---|---|---|
| Comparative 6-1 | +0.56 | +0.10 | −1.24 | −1.37 |
| Invention 6-1 | +0.14 | +0.08 | −1.25 | −0.97 |

Example 7

Use in Phosphor-Containing Photothermographic Materials

To 25 g aliquots of each of the photothermographic emulsion formulations prepared above in Example 8, was added 18.2 g of $YSrTaO_4$ phosphor having an average size of 0.4 μm. The materials were mixed for 15 minutes to prepare the final photothermographic coating formulations. Comparative formulations were also prepared. Photothermographic materials were coated and dried as described in Example 1. The approximate phosphor coating weights were from 76 to 81 g/m$^2$. The photothermographic materials were imaged, developed, and evaluated as described above in Example 1.

The sensitometric results, shown below in TABLE XI, demonstrate that both constructions have similar photospeeds. However, the sample containing compound PS-1 had both lower Dmin and higher contrast than the sample containing compound S-1, even though compound PS-1 was present at 2.5 molar equivalents to compound S-1.

TABLE XI

| Example | Moles of S-1 | Moles of PS-1 | Au-2 Used | $D_{min}$ | SP-2 | AC-1 | AC-2 |
|---|---|---|---|---|---|---|---|
| Comparative 7-1 | $4.41 \times 10^{-5}$ | None | Yes | 1.15 | 4.58 | 3.62 | 4.23 |

TABLE XI-continued

| Example | Moles of S-1 | Moles of PS-1 | Au-2 Used | $D_{min}$ | SP-2 | AC-1 | AC-2 |
|---|---|---|---|---|---|---|---|
| Invention 7-1 | None | $1.12 \times 10^{-4}$ | Yes | 1.00 | 4.56 | 3.81 | 4.36 |

These materials were then aged at ambient temperatures and humidity and the sensitometry was measured again after 12.7 weeks. The changes in Dmin, SP-2, AC-1 and AC-2 after 12.7 weeks, shown below in TABLE XII, demonstrate that the photothermographic material containing compound PS-1 shows improved Dmin and contrast aging as compared to known chemical sensitizer S-1.

TABLE XII

| Example | $\Delta D_{min}$ | ΔSP-2 | ΔAC-1 | ΔAC-2 |
|---|---|---|---|---|
| Comparative 7-1 | +1.25 | +0.05 | −1.14 | −2.47 |
| Invention 7-1 | +0.72 | +0.07 | −0.67 | −1.17 |

The X-ray sensitometric response of these photothermographic materials was determined by exposing the samples using a Fischer X-ray unit operating at 200 mA and 76 KeV and filtered with a 3.0 mm sheet of aluminum. The samples were placed on a table set at 85.5 cm from the X-ray source. A series of X-ray exposures of constant intensity and exposure times of from 0.1 sec to 1.5 sec was made. Exposed samples were processed in a manner similar to that described in Example 1.

The density of these samples were measured with a X-Rite® 310 densitometer using the Status A filters and measured with the visible filter. The sensitometric results, shown below in TABLE XIII, demonstrate that both samples were sensitive to X-radiation. The density of samples incorporating PS compounds of this invention was higher than those of samples incorporating dyes such as S-1. TABLE XIII also shows the materials had good differentiation between developed density and Dmin. In addition, D log E curves showed low Dmin, and good speed and contrast.

TABLE XIII

| Example | (Developed Density − $D_{min}$) at 0.8 sec | (Developed Density − $D_{min}$) at 1.5 sec |
|---|---|---|
| Comparative 7-1 | 3.08 | 3.47 |
| Invention 7-1 | 3.22 | 3.62 |

Example 8

This example compares photothermographic materials incorporating known chemical sensitizing compound C-1 used in combination with compound Au-2 with compound PS-1 used in combination with compound Au-2.

Photothermographic materials were prepared, imaged and developed as described in Example 1 except that 7.9 ml of a solution of $1.53\times10^{-4}$ moles of compound PS-1 in 8.64 g of a 1:1 mixture of MEK/MeOH and 1.77 g of Antifoggant-A in 10.00 g of MEK was used in the photothermographic emulsion formulation, and no Antifoggant-A was added to the topcoat formulation. For comparison, 7.9 ml of a solution of $1.53\times10^{-4}$ moles of compound C-1 in 8.64 g of a 1:1 mixture of MEK/MeOH was added in place of compound PS-1. The silver coating weights were from 2.36 to 2.38 g/m$^2$.

The sensitometric results, shown below in TABLE XIV, demonstrate the increase in speed when the PS compounds of this invention are formulated along with gold(III) compounds when compared with compounds such as C-1 formulated along with gold(III).

TABLE XIV

| Example | Moles of C-1 | Moles of PS-1 | Au-2 used | $D_{min}$ | SP-2 | AC-1 | AC-2 |
|---|---|---|---|---|---|---|---|
| Comparative 8-1 | $1.12 \times 10^{-4}$ | None | Yes | 0.31 | 3.02 | 2.79 | 2.03 |
| Invention 8-1 | None | $1.12 \times 10^{-4}$ | Yes | 0.34 | 4.34 | 3.55 | 3.03 |

Example 9

Use in Phosphor-Containing Photothermographic Materials

To 25 g of each of the photothermographic emulsion formulations prepared above in Example 1, was added 18.2 g of BaFBr:Eu phosphor having an average size of 6.5 μm. The materials were mixed for 15 minutes to prepare the final photothermographic coating formulations. Photothermographic materials were coated and dried as described in Example 1. The approximate phosphor coating weight was 80 g/m$^2$.

The photothermographic materials were imaged, developed, and evaluated as described above in Example 1. The sensitometric results, shown below in TABLE XV, demonstrate the increase in speed when the (PS) compounds of this invention are formulated along with gold(III) compounds in a BaFBr:Eu phosphor-containing photothermographic material.

TABLE XV

| Example | PS Compound | Amount PS Compound | Au-2 Used | $D_{min}$ | SP-2 | AC-1 | AC-2 |
|---|---|---|---|---|---|---|---|
| Comparative 9-1 | None | None | None | 0.64 | 2.88 | 4.37 | 5.09 |
| Comparative 9-2 | None | None | Yes | 0.64 | 2.75 | 4.62 | 5.33 |
| Invention 9-1 | PS-1 | 7.9 ml | Yes | 0.71 | 4.09 | 2.92 | 3.11 |

The X-ray sensitometric response of these photothermographic materials was determined by exposing the samples using a Fischer X-ray unit operating at 200 mA and 76 KeV and filtered with a 3.0 mm sheet of aluminum. The samples were placed on a table set 85.5 cm from the X-ray source. A series of X-ray exposures of constant intensity and exposure times from 0.1 sec to 1.5 sec were made. Exposed samples were developed in a manner similar to that described in Example 1.

The density of these samples were measured with a X-Rite® 310 densitometer using the Status A filters and measured with the visible filter. The sensitometric results, shown below in TABLE XVI, demonstrate the increase in sensitivity to X-rays when the (PS) compounds of this invention are formulated along with gold(III) compounds in a phosphor-containing photothermographic material. TABLE XVI also shows the materials had good differentiation between developed density and Dmin. In addition, D log E curves showed low Dmin, and good speed and contrast.

TABLE XVI

| Example | (Developed Density − $D_{min}$) at 0.8 sec | (Developed Density − $D_{min}$) at 1.5 sec |
|---|---|---|
| Comparative 9-1 | 0.00 | 0.00 |
| Comparative 9-2 | 0.00 | 0.00 |
| Invention 9-1 | 0.97 | 1.65 |

Example 10

Use in Photothermographic Materials

A comparison of photothermographic materials incorporating compound PS-1 and Au-2 with compound S-1, a known sulfur sensitizer described in U.S. Pat. No. 5,891,615 (Winslow et al.) and Au-2 is shown below.

Photothermographic emulsions were prepared, as described in Example 1 except that 7.9 ml of PS-1 solution, 12 g of PIOLOFORM® BM-18 and 8 g of PIOLOFORM® BL-16 were used instead of 20 g of BUTVAR® B-79, and 1.48 g of Antifoggant-A in 16.72 g of MEK were used in the photothermographic emulsion formulation, and Antifoggant-A was not added to the topcoat formulation.

The sample containing compound S-1 was prepared by adding a solution containing 0.02 g of compound S-1 in 2.5 g of methanol and 2.5 g of MEK in place of compound PS-1.

Samples were coated, dried, imaged, and developed as described in Example 1. The silver coating weights were from 2.28 to 2.30 g/m$^2$.

The sensitometric results, shown below in TABLE XVII, demonstrate that both constructions have similar photospeeds. However, the sample containing compound PS-1 had lower Dmin than the sample containing compound S-1, even though compound PS-1 was present at 2.5 molar equivalents to compound S-1.

TABLE XVII

| Example | Moles of S-1 | Moles of PS-1 | Au-2 Used | $D_{min}$ | SP-2 | AC-1 | AC-2 |
|---|---|---|---|---|---|---|---|
| Comparative 10-1 | $4.41 \times 10^{-5}$ | None | Yes | 0.34 | 4.31 | 2.43 | 1.93 |
| Invention 10-1 | None | $1.12 \times 10^{-4}$ | Yes | 0.29 | 4.22 | 2.59 | 1.61 |

These materials were then aged at ambient temperatures and humidity and the sensitometry was measured again after 12.7 weeks. The changes in Dmin, SP-2, AC-1 and AC-2 after 12.7 weeks, shown below in TABLE XVIII, demonstrate that the photothermographic material containing compound PS-1 shows improved Dmin and contrast aging as compared to known chemical sensitizer S-1.

TABLE XVIII

| Example | $\Delta D_{min}$ | ΔSP-2 | ΔAC-1 | ΔAC-2 |
|---|---|---|---|---|
| Comparative 10-1 | +0.48 | +0.02 | −0.89 | −0.76 |
| Invention 10-1 | +0.22 | −0.07 | −0.91 | −0.45 |

Example 11

Use in Photothermographic Materials

A comparison of photothermographic materials incorporating compound PS-1 and Au-2 with compound S-1, a known sulfur sensitizer described in U.S. Pat. No. 5,891,615 (Winslow et al.) and Au-2 is shown below.

Photothermographic emulsions were prepared, as described in Example 1 except that 7.9 ml of PS-1 was added to the photothermographic emulsion formulation, and 12.0 g of PIOLOFORM® BM-18 and 8 g of PIOLOFORM® BL-16 were used instead of BUTVAR® B-79, and Antifoggant-A was not added to the topcoat formulation.

The sample containing compound S-1 was prepared by adding a solution containing 0.02 g of compound S-1 in 2.5 g of methanol and 2.5 g of MEK in place of compound PS-1.

Samples were coated, dried, imaged, and developed as described in Example 1. The silver coating weights were from 2.25 to 2.29 g/m$^2$.

The sensitometric results, shown below in TABLE XIX, demonstrate that both constructions have similar photospeeds. However, the sample containing compound PS-1 had both lower Dmin and higher contrast than the sample containing compound S-1, even though compound PS-1 was present at 2.5 molar equivalents to compound S-1.

TABLE XIX

| Example | Moles of S-1 | Moles of PS-1 | Au-2 Used | $D_{min}$ | SP-2 | AC-1 | AC-2 |
|---|---|---|---|---|---|---|---|
| Comparative 11-1 | $4.41 \times 10^{-5}$ | None | Yes | 0.31 | 4.25 | 3.35 | 2.34 |
| Invention 11-1 | None | $1.12 \times 10^{-4}$ | Yes | 0.30 | 4.19 | 3.45 | 2.91 |

These materials were then aged at ambient temperatures and humidity and the sensitometry was measured again after 12.7 weeks. The changes in Dmin, SP-2, AC-1 and AC-2 after 12.7 weeks, shown below in TABLE XX, demonstrate that the photothermographic material containing compound PS-1 shows improved Dmin and contrast aging as compared to known chemical sensitizer S-1.

TABLE XX

| Example | $\Delta D_{min}$ | ΔSP-2 | ΔAC-1 | ΔAC-2 |
|---|---|---|---|---|
| Comparative 11-1 | +0.18 | +0.01 | −0.93 | −0.87 |
| Invention 11-1 | +0.03 | +0.00 | −0.71 | −0.52 |

Example 12

Use in Phosphor-Containing Photothermographic Materials

To 25 g aliquots of each of the photothermographic emulsion formulations prepared above in Example 11 except that Antifoggant-A was added to the topcoat, was added 18.2 g of $YSrTaO_4$ phosphor having an average size of 4.0 μm.

The materials were mixed for 15 minutes to prepare the final photothermographic coating formulations. Comparative formulations were also prepared. Photothermographic materials were coated and dried as described in Example 1. The approximate phosphor coating weights were at 81 g/m$^2$. The photothermographic materials were imaged, developed, and evaluated as described above in Example 1.

The sensitometric results, shown below in TABLE XXI, demonstrate that both constructions have similar photospeeds. However, the sample containing compound PS-1 had both lower Dmin and higher contrast than the sample containing compound S-1, even though compound PS-1 was present at 2.5 molar equivalents to compound S-1.

TABLE XXI

| Example | Moles of S-1 | Moles of PS-1 | Au-2 Used | $D_{min}$ | SP-2 | AC-1 | AC-2 |
|---|---|---|---|---|---|---|---|
| Comparative 12-1 | $4.41 \times 10^{-5}$ | None | Yes | 0.94 | 4.56 | 3.72 | 4.17 |
| Invention 12-1 | None | $1.12 \times 10^{-4}$ | Yes | 0.85 | 4.53 | 3.88 | 4.18 |

These materials were then aged at ambient temperatures and humidity and the sensitometry was measured again after 12.7 weeks. The changes in Dmin, SP-2, AC-1 and AC-2 after 12.7 weeks, shown below in TABLE XXII, demonstrate that the photothermographic material containing compound PS-1 shows improved Dmin and contrast aging as compared to known chemical sensitizer S-1.

TABLE XXII

| Example | $\Delta D_{min}$ | ΔSP-2 | ΔAC-1 | ΔAC-2 |
|---|---|---|---|---|
| Comparative 12-1 | +0.49 | +0.02 | −0.53 | −1.06 |
| Invention 12-1 | +0.30 | +0.03 | −0.38 | −0.73 |

The X-ray sensitometric response of these photothermographic materials was determined by exposing the samples using a Fischer X-ray unit operating at 200 mA and 76 KeV and filtered with a 3.0 mm sheet of aluminum. The samples were placed on a table set 85.5 cm from the X-ray source. A series of X-ray exposures of constant intensity and exposure times of from 0.1 sec to 1.5 sec was made. Exposed samples were processed in a manner similar to that described in Example 1.

The density of these samples were measured with a X-Rite® 310 densitometer using the Status A filters and measured with the visible filter. The sensitometric results, shown below in TABLE XXIII, demonstrate that both samples were sensitive to X-radiation. The density of samples incorporating PS compounds of this invention was higher than those of samples incorporating dyes such as S-1. TABLE XXIII also shows the materials had good differentiation between developed density and Dmin. In addition, D log E curves showed low Dmin, and good speed and contrast.

TABLE XXIII

| Example | (Developed Density - $D_{min}$) at 0.8 sec | (Developed Density - $D_{min}$) at 1.5 sec |
|---|---|---|
| Comparative 12-1 | 2.64 | 3.32 |
| Invention 12-1 | 2.93 | 3.60 |

Example 13

Use in Photothermographic Materials

The preparation of a photothermographic formulation was carried out as follows:

A preformed silver bromide, silver carboxylate "soap" was prepared as described in U.S. Pat. No. 6,413,710 (Shor et al.). The average grain size was 0.15 μm.

Photothermographic Emulsion Formulation

Chemically sensitized photothermographic emulsions were prepared according to procedures described in U.S. Pat. No. 6,423,481 (Simpson et al.) but incorporating the sulfur-containing compounds of this invention and using the materials and amounts as described below. The materials were added 10 to 60 minutes apart and the temperature during addition ranged from 50° F. to 70° F. (10° C. to 21° C.).

To 163.0 g of this silver soap dispersion at 28.4% solids was added in order:

| | |
|---|---|
| Chemical Sensitizer | 8.1 ml of a $1.53 \times 10^{-4}$ mol solution in 8.64 g of MEOH |
| PHP | 0.20 g in 1.58 g of MeOH |
| Au-2 | 4.8 ml of a solution of 0.0052 g in 50 g of MeOH |
| Chlorobenzoyl benzoic acid | 1.42 g |
| BUTVAR® B-79 | 20 g |
| Antifoggant-A | 1.71 g in 19.4 g of MEK |
| DESMODUR ™ N3300 | 0.63 g in 1.5 g of MEK |
| Phthalazine | 1.0 g in 5 g of MEK |
| Tetrachlorophthalic acid | 0.35 g in 2 g of MEK |
| 4-Methylphthalic acid | 0.45 g in 4 g of MEK |
| PERMANAX® WSO | 10.6 g |

The place at which a solution of $ZnBr_2$ was added (0.169 g in 1.19 g of MeOH) is shown in TABLE XXIV.

Protective Topcoat Formulation

A protective topcoat for the photothermographic emulsion layer was prepared as follows:

| | |
|---|---|
| ACRYLOID® A-21 | 0.58 g |
| CAB 171-15S | 14.9 g |
| MEK | 200 g |
| VS-1 | 0.3 g |
| Benzotriazole | 1.6 g |
| Antifoggant-A | 0.24 g |
| Antifoggant-B | 0.12 g |

The photothermographic formulations were coated, dried, imaged, and developed as described in Example 1.

Emulsion formulations were made with compounds PS-1. The sensitometric results, also shown below in TABLE XXIV demonstrate the effects on Dmin, speed, and contrast by the addition of $ZnBr_2$ before or after the addition of PS-1 compound, or after the PHP oxidizing compound. Higher contrast is observed when $ZnBr_2$ is added before the PHP but after compound PS-1. The fastest speed is observed when $ZnBr_2$ is added before compound PS-1.

TABLE XXIV

| Example | $ZnBr_2$ added Before PS-1 | $ZnBr_2$ added After PS-1 | $ZnBr_2$ added After PHP | $D_{min}$ | SP-2 | AC-1 | AC-2 |
|---|---|---|---|---|---|---|---|
| Invention 13-1 | Yes | No | No | 0.31 | 4.04 | 3.41 | 2.52 |
| Invention 13-2 | No | Yes | No | 0.28 | 3.88 | 3.84 | 3.27 |
| Invention 13-3 | No | No | Yes | 0.29 | 3.93 | 2.95 | 1.96 |

Example 14

Use in Phosphor-Containing Photothermographic Materials

To 25 g of each of the photothermographic emulsion formulations prepared above in Example 13, was added 18.2 g of $YSrTaO_4$ phosphor having an average size of 4.0 μm. The materials were mixed for 5 minutes to prepare the final photothermographic coating formulations. Photothermographic materials were coated and dried as described in Example 1. The approximate phosphor coating weights were from 76 to 77 $g/m^2$.

The photothermographic materials were imaged, developed, and evaluated as described above in Example 1. The sensitometric results, shown below in TABLE XXV, demonstrate the effects on Dmin, speed and contrast by the addition of $ZnBr_2$ before or after the PS compound (PS-1), or after the oxidizing compound (PHP). Higher contrast is observed when $ZnBr_2$ is added before the oxidizing compound (PHP) but after the PS compound (PS-1). The fastest speed is observed with $ZnBr_2$ addition before the PS compound.

TABLE XXV

| Example | $ZnBr_2$ added Before PS-1 | $ZnBr_2$ added After PS-1 | $ZnBr_2$ added After PHP | $D_{min}$ | SP-2 | AC-1 | AC-2 |
|---|---|---|---|---|---|---|---|
| Invention 14-1 | Yes | No | No | 0.87 | 4.39 | 3.68 | 4.30 |
| Invention 14-2 | No | Yes | No | 0.77 | 4.21 | 3.96 | 4.58 |
| Invention 14-3 | No | No | Yes | 0.82 | 4.31 | 3.39 | 3.95 |

The X-ray sensitometric response of these photothermographic materials was determined by exposing the samples using a Fischer X-ray unit operating at 200 mA and 76 KeV and filtered with a 3.0 mm sheet of aluminum. The samples were placed on a table set 85.5 cm from the X-ray source. A series of X-ray exposures of constant intensity and exposure times from 0.1 sec to 1.5 sec were made. Exposed samples were developed in a manner similar to that described in Example 1.

The density of these samples were measured with an X-Rite® 310 densitometer using the Status A filters and measured with the visible filter. The sensitometric results, shown below in TABLE XXVI, demonstrate the increase in sensitivity to X-rays when the diphenylphosphine sulfide compounds are formulated along with gold(III) compounds in a phosphor-containing photothermographic material. The highest sensitivity to X-ray was observed with addition of $ZnBr_2$ before the PS compound (PS-1). TABLE XXVI also shows the materials had good differentiation between developed density and Dmin. In addition, D log E curves showed low Dmin, and good speed and contrast.

TABLE XXVI

| Example | (Developed Density - $D_{min}$) at 0.8 sec | (Developed Density - $D_{min}$) at 1.5 sec |
|---|---|---|
| Invention 14-1 | 3.19 | 3.86 |
| Invention 14-2 | 2.36 | 3.48 |
| Invention 14-3 | 2.54 | 3.40 |

Example 15

Use in Photothermographic Materials

Photothermographic emulsion and protective topcoat formulations were prepared as described in Example 13 above. The emulsion formulations were made with compound PS-1. The place in the preparation of the photothermographic formulation at which a solution of $ZnBr_2$ was added is shown in TABLE XXVII. The solution was added either as a solution of 0.169 g in 1.19 g of MeOH or as two additions of 0.0845 g in 0.595 g of MeOH.

The photothermographic formulations were coated, dried, imaged, developed, and evaluated as described in Example 1.

The sensitometric results, shown below in TABLE XXVII demonstrates the effects on the Dmin, speed and contrast by the placement of the $ZnBr_2$ before or split before and after the PS-1 compound. Higher speed is observed with the placement of the $ZnBr_2$ split before and after PS-1 compound.

TABLE XXVII

| Example | All ZnBr2 Added Before PS-1 | Half $ZnBr_2$ Added Before PS-1 and Half Added After PS-1 | $D_{min}$ | SP-2 | AC-1 | AC-2 |
|---|---|---|---|---|---|---|
| Invention 15-1 | Yes | No | 0.35 | 3.77 | 3.82 | 3.67 |
| Invention 15-2 | No | Yes | 0.35 | 3.88 | 3.60 | 3.61 |

Example 16

Use in Phosphor-Containing Photothermographic Materials

To 25 g of each of the photothermographic emulsion formulations prepared above in Example 15, was added 18.2 g of $YSrTaO_4$ phosphor having an average size of 4.0 μm. The materials were mixed for 5 minutes to prepare the final photothermographic coating formulations. Photothermographic materials were coated and dried as described in Example 1. The approximate phosphor coating weights were from 77 to 78 g/m$^2$.

The photothermographic materials were imaged, developed, and evaluated as described above in Example 1. The sensitometric results, shown below in TABLE XXVIII, demonstrates the effects on the Dmin, speed and contrast by the placement of the $ZnBr_2$ before or split before and after the PS-1 compound. Higher contrast is observed with the placement of the $ZnBr_2$ added before the PHP but after compound PS-1. The fastest speed is observed with the $ZnBr_2$ split before and after compound PS-1.

TABLE XXVIII

| Example | All ZnBr2 Added Before PS-1 | Half $ZnBr_2$ Added Before PS-1 and Half Added After PS-1 | $D_{min}$ | SP-2 | AC-1 | AC-2 |
|---|---|---|---|---|---|---|
| Invention 16-1 | Yes | No | 1.08 | 4.13 | 3.91 | 4.50 |
| Invention 16-2 | No | Yes | 1.05 | 4.23 | 3.82 | 4.37 |

The X-ray sensitometric response of these photothermographic materials was determined by exposing the samples using a Fischer X-ray unit operating at 200 mA and 76 KeV and filtered with a 3.0 mm sheet of aluminum. The samples were placed on a table set at 85.5 cm from the X-ray source. A series of X-ray exposures of constant intensity and exposure times from 0.1 sec to 1.5 sec were made. Exposed samples were developed in a manner similar to that described in Example 1.

The density of these samples were measured with an X-rite 310 densitometer using the Status A filters and measured with the visible filter. The sensitometric results, shown below in TABLE XXIX, demonstrate the increase in sensitivity to X-rays when the diphenylphosphine sulfide compounds are formulated in a phosphor-containing photothermographic material. The highest sensitivity to X-ray was observed with the placement of the $ZnBr_2$ split before and after PS-1 compound. TABLE XXIX also shows the materials had good differentiation between developed density and Dmin. In addition, D log E curves showed low Dmin, and good speed and contrast.

TABLE XXIX

| Example | (Developed Density - $D_{min}$) at 0.8 sec | (Developed Density - $D_{min}$) at 1.5 sec |
|---|---|---|
| Invention 16-1 | 3.70 | 4.82 |
| Invention 16-2 | 4.04 | 4.91 |

The invention has been described in detail with particular reference to certain preferred embodiments thereof, but it will be understood that variations and modifications can be effected within the spirit and scope of the invention.

The invention claimed is:

1. A method of preparing a photothermographic emulsion comprising:

(A) providing a dispersion of a preformed photosensitive silver halide grains and a non-photosensitive source of reducible silver ions, (B) providing one or more sulfur-containing compounds that is a diphenylphosphine sulfide compound, in association with said preformed silver halide grains and said non-photosensitive source of reducible silver ions, said diphenylphosphine sulfide compound being represented by the by the following Structure PS:

(PS)

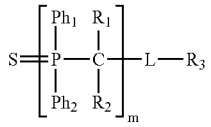

wherein $Ph_1$ and $Ph_2$ are the same or different phenyl groups, $R_1$ and $R_2$ are independently hydrogen or an alkyl or phenyl group, L is a direct bond or a linking group, m is 1 or 2 and when m is 1, $R_3$ is a monovalent group, and when m is 2, $R_3$ is a divalent aliphatic linking group having 1 to 20 carbon, nitrogen, oxygen, and sulfur atoms in the chain, (C) chemically sensitizing said preformed silver halide grains by decomposing said diphenylphosphine sulfide compound on or around said silver halide grains in an oxidizing environment to provide sulfur chemically sensitized photosensitive silver halide grains in reactive association with said non-photosensitive source of reducible silver ions, and (D) providing a gold(III)-containing compound in association with said preformed silver halide grains and said non-photosensitive source of reducible silver ions to provide gold(III) chemically sensitized photosensitive silver halide grains in reactive association with said non-photosensitive source of reducible silver ions, said gold(III)-containing compound represented by the following structure GOLD:

$$Au(III)L'_rY_q \qquad \text{(GOLD)}$$

wherein L' represents the same or different ligands, each ligand comprising at least one heteroatom that is capable of forming a bond with gold, Y is an anion, r is an integer of from 1 to 8, and q is an integer of form 0 to 3, the molar ratio of said gold(III)-containing compound to said sulfur-containing compound used in the chemical sensitization is at least 1:1.

2. The method of claim 1 wherein the molar ratio of said sulfur-containing compound to said gold(III)-containing compound is from about 5,000:1 to about 1:1, and said photosensitive silver halide grains are chemically sensitized with said sulfur-containing compound in an amount of from about $10^{-6}$ to about $10^{-1}$ mole per mole of total silver and with said gold(III)-containing compound in an amount of from about $10^{-8}$ to about $10^{-2}$ mole per mole of total silver.

3. The method of claim 1 wherein the steps are carried out in the order of step (A), step (B), step (C), and step (D).

4. The method of claim 1 wherein steps (B) and (D) are carried out simultaneously and before step (C).

5. The method of claim 1 wherein said diphenylphosphine sulfide compound is decomposed in an oxidizing environment.

6. The method of claim 5 wherein said oxidizing agent is a hydrobromic acid salt of an N-heterocyclic compound that is associated with a pair of bromine atoms.

7. The method of claim 1 wherein step (C) is carried out at a temperature of from about 10° C. to about 30° C. for up to 60 minutes.

8. The method of claim 1 further comprising, after step (C), adding a spectral sensitizing dye to spectrally said photosensitive silver halide grains to from about 400 nm to about 1100 nm.

9. The method of claim 1 further comprising adding a reducing agent composition to said photothermographic emulsion.

10. The method of claim 1 further comprising:

(E) converting some of the reducible silver ions in said non-photosensitive source of reducible silver ions to photosensitive silver halide.

11. The method of claim 10 wherein the conversion of some of the reducible silver ions in said non-photosensitive source of reducible silver ions into photosensitive silver halide grains is carried out by one or more additions of an inorganic halide or an organic halogen containing compound.

12. The method of claim 11 wherein said inorganic halide is selected from the group consisting of lithium bromide, calcium bromide, zinc bromide, and zinc iodide.

13. The method of claim 10 wherein the steps are carried out in the order of step (A), step (B), step (C), step (D), and step (E).

14. The method of claim 1 wherein the steps are carried out in the order of step (A), step (B), step (D), and step (C).

15. The method of claim 1 further comprising adding one or more phosphors to said photothermographic emulsion.

16. A method of preparing a photothermographic material comprising:

(A) providing a dispersion of preformed photosensitive silver halide grains and a non-photo-sensitive source of reducible silver ions, (B) providing a sulfur-containing compound that is a diphenylphosphine sulfide compound in association with said preformed silver halide grains and said non-photosensitive source of reducible silver ions, said diphenylphosphine sulfide represented by the by the following Structure PS:

(PS)

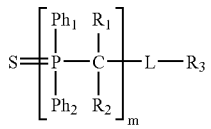

wherein $Ph_1$ and $Ph_2$ are the same or different phenyl groups, $R_1$ and $R_2$ are independently hydrogen or an alkyl or phenyl group, L is a direct bond or a linking group, m is 1 or 2 and when m is 1, $R_3$ is a monovalent group, and when m is 2, $R_3$ is a divalent aliphatic linking group having 1 to 20 carbon, nitrogen, oxygen, and sulfur atoms in the chain.

(C) chemically sensitizing said preformed silver halide grains by decomposing said diphenylphosphine sulfide compound on or around said silver halide grains in an oxidizing environment to provide sulfur chemically sensitized photosensitive silver halide grains in reactive association with said non-photosensitive source of reducible silver ions, (D) providing a gold(III)-containing compound in association with said preformed silver halide grains and said non-photosensitive source of reducible silver ions to provide gold(III) chemically sensitized photosensitive silver halide grains in reactive association with said non-photosensitive source of reducible silver ions, said gold(III)-containing compound represented by the following structure GOLD:

$$Au(III)L'_rY_q \qquad \text{(GOLD)}$$

wherein L' represents the same or different ligands, each ligand comprising at least one heteroatom that is capable of forming a bond with gold, Y is an anion, r is an integer of from 1 to 8, and q is an integer of form 0 to 3, and (E') simultaneously with any of steps (B) through (D), or subsequently to step (D), adding a binder to form an emulsion formulation, and (F) after step (E'), coating and drying said emulsion formulation on a support to provide a photothermographic imaging material.

17. The method of claim 16 wherein the steps are carried out in the order of step (A), step (B), step (C), step (D), step (E'), and step (F).

18. The method of claim 16 wherein steps (B) and (D) are carried out simultaneously.

19. The method of claim 16 wherein said diphenylphosphine sulfide compound is decomposed by the presence of a hydrobromic acid salt of a N-heterocyclic compound that is associated with a pair of bromine atoms.

20. The method of claim 16 further comprising, after step (C), adding a spectral sensitizing dye to spectrally said photosensitive silver halide grains to from about 400 nm to about 1100 nm.

21. The method of claim 16 further comprising adding a reducing agent composition to said photothermographic emulsion, and (E) converting some of the reducible silver ions in said non-photosensitive source of reducible silver ions into photosensitive silver halide grains by addition of an inorganic or an organic halide.

22. The method of claim 21 wherein said inorganic halide is selected from the group consisting of lithium bromide, calcium bromide, and zinc bromide.

23. The method of claim 21 wherein the steps are carried out in the order of step (A), step (B), step (C), step (D), step (E), step (E'), and step (F).

24. The method of claim 16 wherein the steps are carried out in the order of step (A), step (B), step (D), step (C), step (E'), and step (F).

25. The method of claim 16 wherein the steps are carried out in the order of step (A), step (D), step (B), step (C), step (E), and step (F).

26. The method of claim 16 further comprising adding one or more phosphors to said photothermographic emulsion.

* * * * *

UNITED STATES PATENT AND TRADEMARK OFFICE

CERTIFICATE OF CORRECTION

PATENT NO. : 7,157,219 B2
APPLICATION NO. : 11/240560
DATED : January 02, 2007
INVENTOR(S) : Sharon M. Simpson et al.

It is certified that error appears in the above-identified patent and that said Letters Patent is hereby corrected as shown below:

| | |
|---|---|
| Col. 68, line 46 | In Claim 1, after “by the” delete “by the”. |
| Col. 69, line 17 | In Claim 1, delete “form” and insert -- from --, therefor. |
| Col. 70, line 13 | In Claim 16, after “by the” delete “by the”. |
| Col. 70, line 29 | In Claim 16, delete “chain.” and insert -- chain, --, therefor. |
| Col. 70, line 51 | In Claim 16, delete “form” and insert -- from --, therefor. |

Signed and Sealed this

Fifteenth Day of May, 2007

JON W. DUDAS
*Director of the United States Patent and Trademark Office*